US006227882B1

(12) United States Patent
Ortega et al.

(10) Patent No.: US 6,227,882 B1
(45) **Date of Patent: *May 8, 2001**

(54) CONNECTOR FOR ELECTRICAL ISOLATION IN A CONDENSED AREA

(75) Inventors: Jose L. Ortega, Camp Hill; John R. Ellis, Harrisburg, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/045,660

(22) Filed: Mar. 20, 1998

Related U.S. Application Data

(63) Continuation-in-part of application No. 08/942,084, filed on Oct. 1, 1997, now abandoned.

(51) Int. Cl.[7] ..... H01R 4/66; H01R 13/648

(52) U.S. Cl. ..... 439/101; 439/862

(58) Field of Search ..... 439/101, 108, 439/608, 660, 862

(56) References Cited

U.S. PATENT DOCUMENTS

| | | | | |
|---|---|---|---|---|
| 3,871,728 | * | 3/1975 | Goodman | 339/14 R |
| 4,686,607 | * | 8/1987 | Johnson | 361/413 |
| 4,846,727 | | 7/1989 | Glover et al. | 439/608 |
| 4,898,546 | | 2/1990 | Elco et al. | 439/608 |
| 4,914,062 | | 4/1990 | Voltz | 439/608 |
| 4,975,084 | | 12/1990 | Fedder et al. | 439/608 |
| 5,055,069 | | 10/1991 | Townsend et al. | 439/608 |
| 5,080,613 | * | 1/1992 | Orui et al. | 439/660 |
| 5,104,341 | | 4/1992 | Gillissen et al. | 439/608 |
| 5,133,679 | | 7/1992 | Fusselman et al. | 439/608 |
| 5,135,405 | | 8/1992 | Fusselman et al. | 439/108 |
| 5,141,453 | | 8/1992 | Fusselman et al. | 439/608 |
| 5,151,036 | | 9/1992 | Fusselman et al. | 439/108 |
| 5,174,770 | | 12/1992 | Sasaki et al. | 439/108 |
| 5,238,414 | | 8/1993 | Yaegashi et al. | 439/108 |
| 5,310,354 | | 5/1994 | Oswald | 439/108 |
| 5,403,206 | | 4/1995 | McNamara et al. | 439/608 |
| 5,421,735 | | 6/1995 | Dechelette | 439/101 |
| 5,507,655 | | 4/1996 | Goerlich | 439/108 |
| 5,547,385 | * | 8/1996 | Spangler | 439/101 |
| 5,660,551 | | 8/1997 | Sakurai | 439/108 |
| 5,716,237 | | 2/1998 | Conorich et al. | 439/660 |
| 6,056,559 | * | 5/2000 | Olson | 439/108 |
| 6,073,229 | * | 6/2000 | Crane, Jr. et al. | 439/660 |
| 6,083,047 | * | 7/2000 | Paagman | 439/608 |

* cited by examiner

*Primary Examiner*—Brian Sircus
*Assistant Examiner*—Javaid Nasri
(74) *Attorney, Agent, or Firm*—Brian J. Hamilla; M. Richard Page; Steven M. Reiss

(57) ABSTRACT

An interconnection system having a first connector with a plurality of contacts; and a second connector with a plurality of contacts. The contacts of the first connector engage the contacts on the second connector, creating unbalanced resultant forces an the contacts of the second connector. The unbalanced resultant forces caused by a set of the contacts of the second connector generally offset the unbalanced forces caused by another set of contacts on the second connector. Thus, the contacts balance the forces created during mating, providing a generally balanced interconnection system.

52 Claims, 27 Drawing Sheets

CONNECTOR FOR ELECTRICAL ISOLATION IN A CONDENSED AREA

This is a continuation-in-part of application Ser. No. 08/942,084 filed Oct. 1, 1997, now abandoned.

FIELD OF THE INVENTION

The present invention relates in general to electrical connectors. More particularly, the present invention relates to electrical connectors having densely packed contact members capable of passing signals without crosstalk between adjacent contact members.

BACKGROUND OF THE INVENTION

In electronic equipment, there is a need for electrical connectors providing connections in signal paths, and often the signal paths are so closely spaced that difficulties arise from interference between signals being transmitted along adjacent paths.

In order to minimize such difficulties it is known to provide grounding connections in such connectors, such connections serving in effect to filter out undesired interference between signal paths.

However, mere grounding is not always sufficient, and this is particularly so in connectors in which contacts constituting the signal paths through the connector extend through sharp angles, because interference between adjacent signal paths is a particularly large problem in such connectors.

In many situations where electrical signals are being carried among separate subassemblies of complex electrical and electronic devices, reduced size contributes greatly to the usefulness or convenience of the devices or of certain portions of them. To that end, cables including extremely small conductors are now available, and it is practical to manufacture very closely spaced terminal pads accurately located on circuit boards or the like. It is therefore desirable to have a connector of reduced size, to interconnect such cables and circuit boards repeatedly, easily, and reliably, and with a minimum adverse effect on electrical signal transmission in a circuit including such a connector.

In high speed backplane applications, low crosstalk between signal currents passing through the connector is desirable. Additionally, maximizing signal density is also desirable. Low crosstalk insures higher signal integrity. High density increases the number of circuits that can be routed through the connector.

Pin and socket type connectors are typically used to achieve a disconnectable, electrically reliable interface. Moreover, reliability is further increased by providing two redundant, cantilever-type points of contact. Conventional approaches typically locate two receptacle cantilever beams on opposing sides of a projecting pin or blade. This 180° "opposing-beam" method requires a significant amount of engagement clearance in the plane that is defined by the flexing movement of the cantilever beams during engagement. Additionally, due to manufacturing tolerances, end portions of the beams are angled outward from the center lengthwise axis of a mating pin or blade in order to prevent stubbing during initial engagement. This clearance for spring beam flexure and capture projections creates a requirement for contact clearance in the "flexing plane". This clearance must be accommodated in the connector receptacle housing, thereby becoming a significant limiting factor in improving connector density.

To achieve minimum crosstalk through a coaxial-like isolation of the signal current passing within the connector, isolation in both vertical and horizontal planes alongside the entire connector signal path (including the engagement area) is desired. Clearance requirements in the opposing cantilever beam flexing plane conflicts with requirements for vertical and horizontal electrical isolation while simultaneously maintaining or increasing connector density.

A method for achieving electrical isolation with use of an "L-shaped" ground contact structure is described in a U.S. patent issued to Sakurai (U.S. Pat. No. 5,660,551) and which is hereby incorporated by reference for its teachings on L-shaped ground contact structures. Along the length of the receptacle connector, Sakurai creates an L-shape within the cross-section of the ground contact body. In the contact engagement means area, Sakurai transitions to a flat, conventional dual cantilever beam receptacle ground contact and relies on a 90° rotated flat projecting blade, thereby producing an L-shape cross-section when the blade and the receptacle are engaged. This transition of the L-shaped structure in the contact engagement section limits density due to the above described flexingplane clearance concerns with both the signal and ground dual-beam contacts and also creates an opportunity for producing gap sections where full coaxial-like isolation cannot be maintained. Moreover, in Sakurai, all four cantilever beams flexing planes are oriented in parallel fashion, thereby limiting density.

One conventional method of transmitting data along a transmission line is the common mode method, which is also referred to as single ended. Common mode refers to a transmission mode which transmits a signal level referenced to a voltage level, preferably ground, that is common to other signals in the connector or transmission line. Another conventional method of transmitting data along a transmission line is the differential mode method. Differential mode refers to a method where a signal on one line of voltage V is referenced to a line carrying a complement voltage of −V. The resulting output is V−(−V) or 2V.

A limitation of common mode signaling is that any noise on the line will be transmitted along with the signal. This common mode noise most often results from instability in the voltage levels of the common reference plane, a phenomenon called ground bounce. To reduce noise in signal transmission, signals are driven differentially. Any common mode noise is canceled at the differential receiver. This phenomenon is called common mode noise rejection and is a primary benefit of differential signaling.

Implementation of differential pairing in a high speed right angle backplane connectors is typically column-based because shields at ground potential are inserted between the columns of contacts within the connector. In other words, in order to improve signal integrity, the prior art typically uses a column-based pair design, such as that found in the VHDM products manufactured by Teradyne, Inc. of Boston, Mass. In column-based pairing, skew is introduced between the true and complement voltages of the differential pair. One of the pair of signals will arrive sooner than the other signal. This difference in arrival time degrades the efficiency of common mode noise rejection in the differential mode and slows the output risetime of the differential signal. Thus, because bandwidth, which is a measure of how much data can be transmitted through a transmission line structure, is inversely related to the length of the risetime by Bandwidth= 0.35/Risetime, the amount of the data throughput is degraded by column-based pairing.

Although the art electrical connectors is well developed, there remain some problems inherent in this technology, particularly densely packing contact members while preventing crosstalk between adjacent contact members. Therefore, a need exists for electrical connectors that have small footprints while maintaining signal integrity.

SUMMARY OF THE INVENTION

The present invention is directed to a connector for mounting to a circuit substrate comprising a housing, and a connector module supported by the housing, the connector module including a header connector comprising a ground pin and a signal pin; and a socket connector comprising a ground receptacle contact and a signal receptacle contact, wherein the ground pin engages the ground receptacle contact to generate forces in a first and a second direction, and the signal pin engages the signal receptacle contact to generate forces in a third and a fourth direction, the forces in the first and third directions opposing each other and the forces in the second and fourth directions opposing each other.

In a further embodiment within the scope of the present invention, the first and second directions are perpendicular to each other, and the third and fourth directions are perpendicular to each other.

According to further aspects of the invention, the ground pin has an L-shaped cross-section having two sides at the end of the L-shape, the ground receptacle contact has an L-shaped cross-section, and the signal receptacle contact has an L-shaped cross-section, and the ground pin engages the ground receptacle contact at the two sides of the L-shape. Moreover, the signal pin has a rectangular cross-section and engages the signal receptacle contact on two adjacent sides.

In a further embodiment within the scope of the present invention, the signal pin is disposed diagonal to the ground pin.

In a further embodiment within the scope of the present invention, the ground receptacle contact and the signal receptacle contact are 90 degree offset dual beam contacts and the ground receptacle contact is disposed in a reversed orientation with respect to the signal receptacle contact.

In a further embodiment within the scope of the present invention, a connector for mounting to a circuit substrate comprises a housing, and a connector module supported by the housing, the connector module including a header connector comprising a ground terminal having a plurality of pins, and a signal pin; and a socket connector comprising a ground receptacle contact and a signal receptacle contact. The ground terminal has two pins, and each of the two pins has an L-shaped cross-section, each L-shaped cross-section pin having two sides at the end of the L-shape, and the ground terminal engages the ground receptacle contact at the two sides of the L-shape of one of the L-shaped cross-section pins, to generate forces in a first and a second direction, and the signal pin engages the signal receptacle contact to generate forces in a third and a fourth direction, the forces in the first and third directions opposing each other and the forces in the second and fourth directions opposing each other.

According to further aspects of the invention, the ground terminal comprises a first contact section and a second contact section, the first contact section coupled to the second contact section, and the plurality of pins are provided on the second contact section. Moreover, each of the first and second contact sections has a plurality of protrusions and raised portions, the protrusions and raised portions in a cooperative relationship to couple the first contact section to the second contact section. Furthermore, the two pins are disposed in a mirror relationship.

According to a further aspect of the invention, the signal pin is disposed diagonal to the ground terminal; the header connector further comprises a second signal pin disposed diagonal to the ground terminal; the socket connector further comprises a second ground receptacle contact and a second signal receptacle contact; and one of the two pins of the ground terminal engages the first ground receptacle contact, the other of the two pins of the ground terminal engages the second ground receptacle contact, the signal pin engages the signal receptacle contact, and the second signal pin engages the second signal receptacle contact. The two pins are disposed in a mirror relationship, the second ground receptacle contact is disposed in a mirror relationship to the ground receptacle contact, and the second signal receptacle contact is disposed in a mirror relationship to the signal receptacle contact. The ground terminal has a tail and the connector module further comprises a second ground terminal in electrical contact with the tail of the ground terminal.

In a further embodiment within the scope of the present invention, an electrical interconnection comprises a header connector having a first substantially rectangular array of signal pins and a second substantially rectangular array of ground pins, the first and second arrays being offset along a diagonal direction one with respect to the other; a receptacle connector comprising a third substantially rectangular array of signal receptacle terminals arranged to mate with the first array of signal pins and a fourth substantially rectangular array of ground receptacle terminals arranged to mate with the second array of ground pins, the third and fourth arrays being offset and diagonally related one with respect to the other; each signal receptacle terminal comprising a pair of contact elements, one contact element applying a contact force generally transverse to a mating pin in a first direction and the other contact element applying a contact force on the pin in a second direction orthogonal to the first direction; each ground receptacle terminal comprising a pair of contact terminals, one of the ground receptacle contact terminals applying a contact force transverse to a mating pin in a direction parallel and opposite to the first direction and the other ground receptacle contact terminal applying a contact force to the mating pin in a direction parallel and opposite to the second direction. A first resultant of the contact forces on the signal pin and a second resultant of the contact forces on the ground pin are substantially equal and in opposite directions. The first and the second resultants are co-linear along the diagonal direction.

The foregoing and other aspects of the present invention will become apparent from the following detailed description of the invention when considered in conjunction with the accompanying drawing.

DESCRIPTION OF EXEMPLARY EMBODIMENTS AND BEST MODE

The present invention is directed to an electrical connector module having a compact profile that provides a coaxial-like electrical isolation of signal connections. The present invention provides signal isolation integrity within a contact engagement region in a minimized size profile by isolating contacts in the horizontal and vertical planes.

Figure 1:
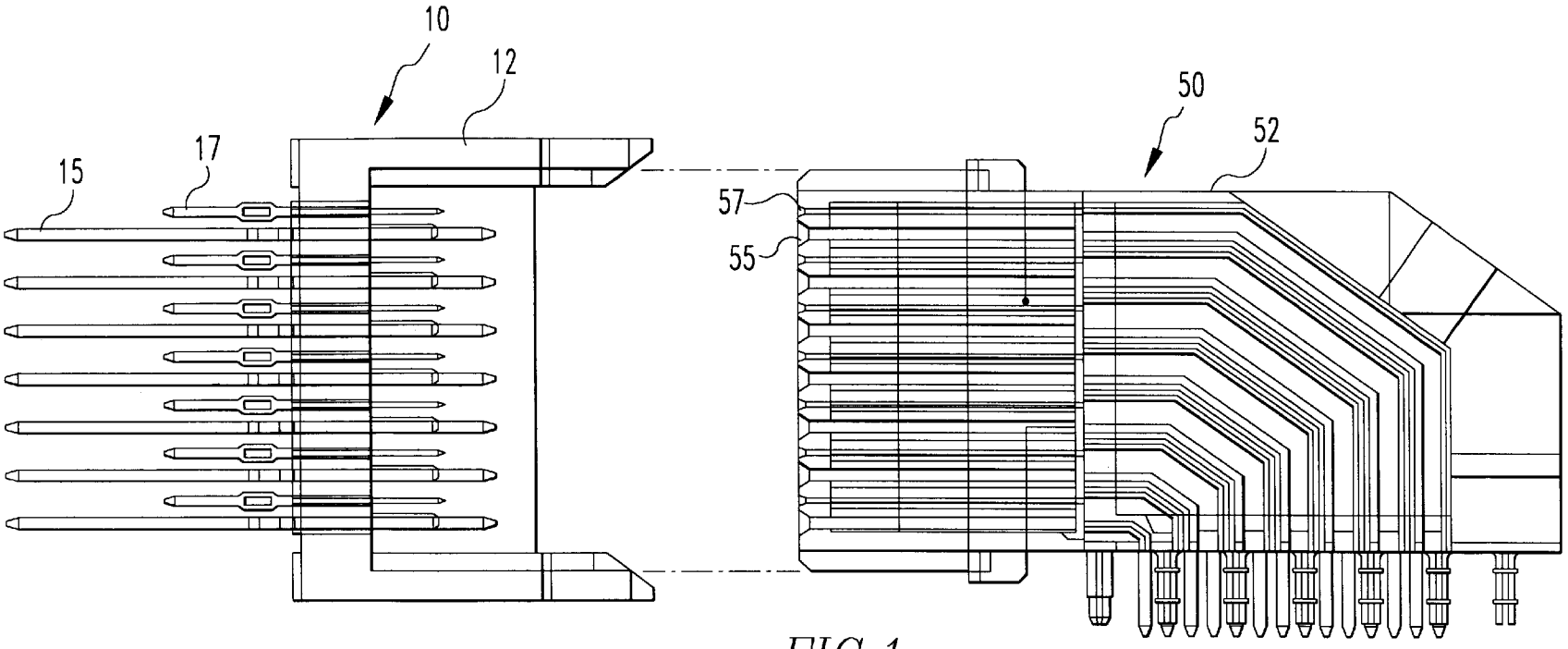
FIG. 1 is a sectional side elevational view of a first embodiment of a high speed transmission connector, with the parts separated, according to the present invention.

FIG. 1 is a sectional side elevational view of a first embodiment of a high speed transmission connector, with the parts separated, according to the present invention. A straight type of header connector 10 is comprised of a header housing 12 and pins (male contacts) 15 for a signal transmission line and pins (male contacts) 17 for a ground line. These pins 15 and 17 are alternately arranged in a plurality of rows on the header housing 12 of the associated connector 10. The housing is preferably molded, using a plastic material such as a high temperature thermoplastic. The pins are preferably stamped and formed with the preferred material being phosphor bronze or beryllium copper. The header connector 10 can be mounted on or connected to a first printed card, called a motherboard. A right angle type of socket connector 50 is comprised of a receptacle housing 52, signal receptacle contacts 55 for a signal transmission line, and ground receptacle contacts 57 for a ground line. A plurality of rows of the contacts 55 and 57 are regularly arranged so as to correspond to those of the header connector 10. The socket connector 50 can be connected to or mounted on a second printed card, called a daughterboard. The housing 52 is preferably molded, using a plastic material such as a high temperature thermoplastic. The contacts are preferably stamped and formed of beryllium copper or phosphor bronze.

Figure 2A:
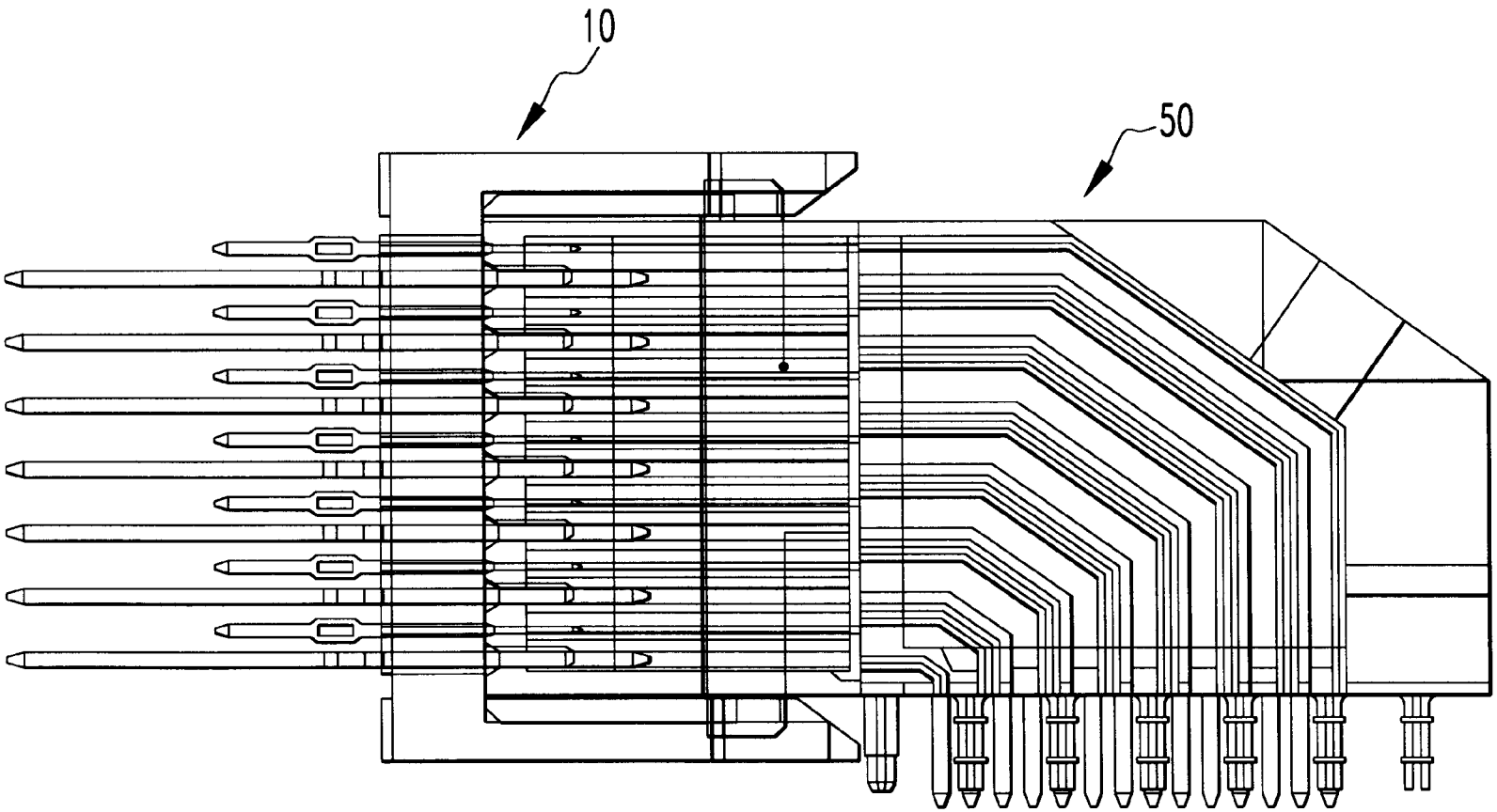
FIG. 2A is a sectional view of the connector of FIG. 1 with the parts assembled.
Figure 2B:
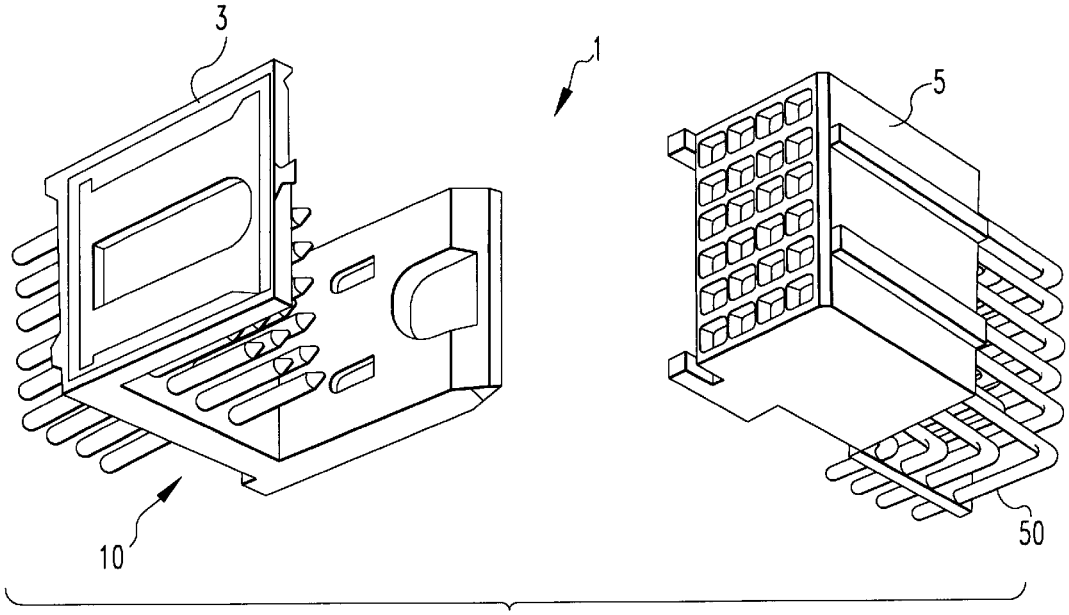
FIG. 2B is a perspective view of an array of a plurality of the connectors of FIG. 2A arranged in a housing, with the parts separated.

FIG. 2A is a sectional view of the connector of FIG. 1 with the parts assembled. A plurality of the connectors of FIG. 2A can be arranged in a housing 1 in an array pattern, as shown in FIG. 2B. The housing 1 is preferably formed of an electrically insulating material and comprises a header housing 3 having an array of header connectors 10, and a socket housing 5 having an array of socket connectors 50.

Figure 3:
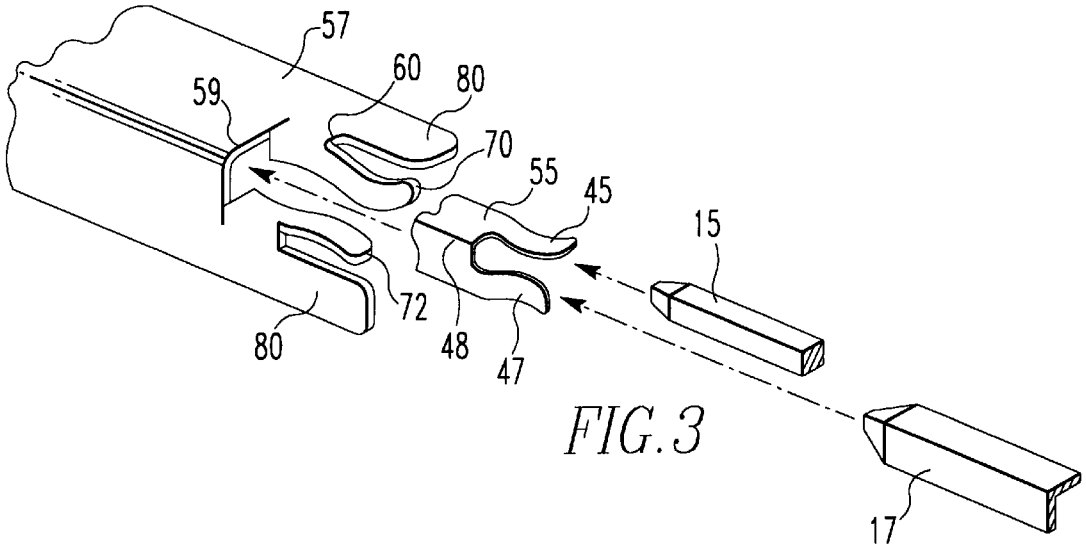
FIG. 3 shows a perspective view of an exemplary connector module in accordance with the present invention.
Figure 4:
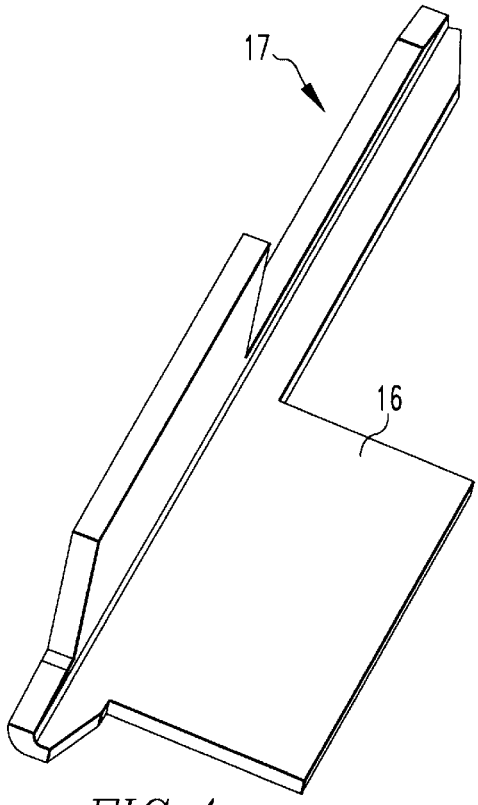
FIG. 4 is a perspective view of an exemplary ground pin in accordance with the present invention.
Figure 5:
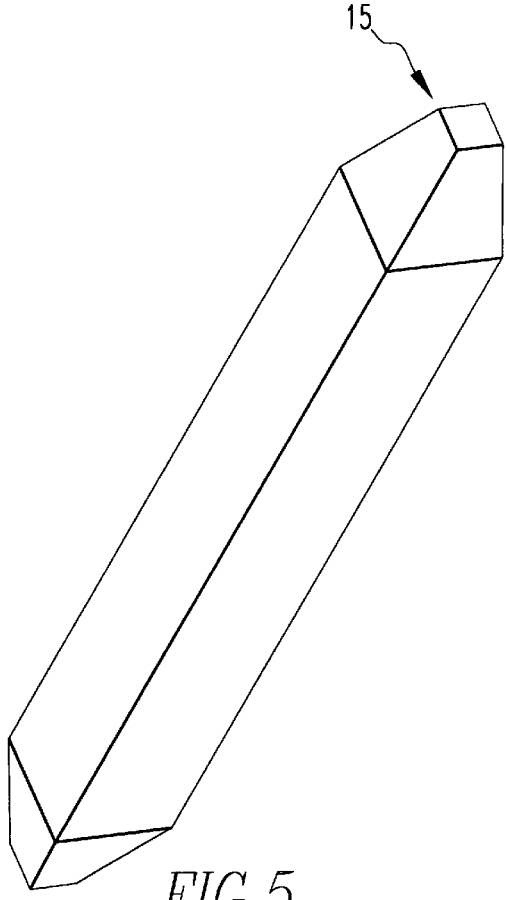
FIG. 5 is a perspective view of an exemplary signal pin in accordance with the present invention.

FIG. 3 shows a perspective view of an exemplary connector module in accordance with the present invention. In the perspective view of FIG. 3, the parts are separated. A header connector comprises a signal pin 15 and a ground pin 17. FIG. 4 is a perspective view of an exemplary ground pin in accordance with the invention. The ground pin 17 is preferably cross-sectionally L-shaped and extends from the base of the header connector. The ground pin 17 preferably has plates 16 protruding from the sides of portions of the ground pin 17. These plates 16 provide isolation and shielding in the header connecter. The L-shape is material-efficient and increases flexural stiffness. FIG. 5 is a perspective view of an exemplary signal pin in accordance with the present invention. The signal pin 15 is also provided on the base of the header connector. The ground pin 17 is preferably located in a diagonal orientation with respect to the signal pin 15.

A socket connector comprises a signal receptacle contact 55 and a ground receptacle contact 57. The receptacle contacts 55 and 57 are preferably a 90° offset dual-beam signal receptacle contact and a 90° offset dual-beam ground receptacle contact, respectively.

Figure 6A:
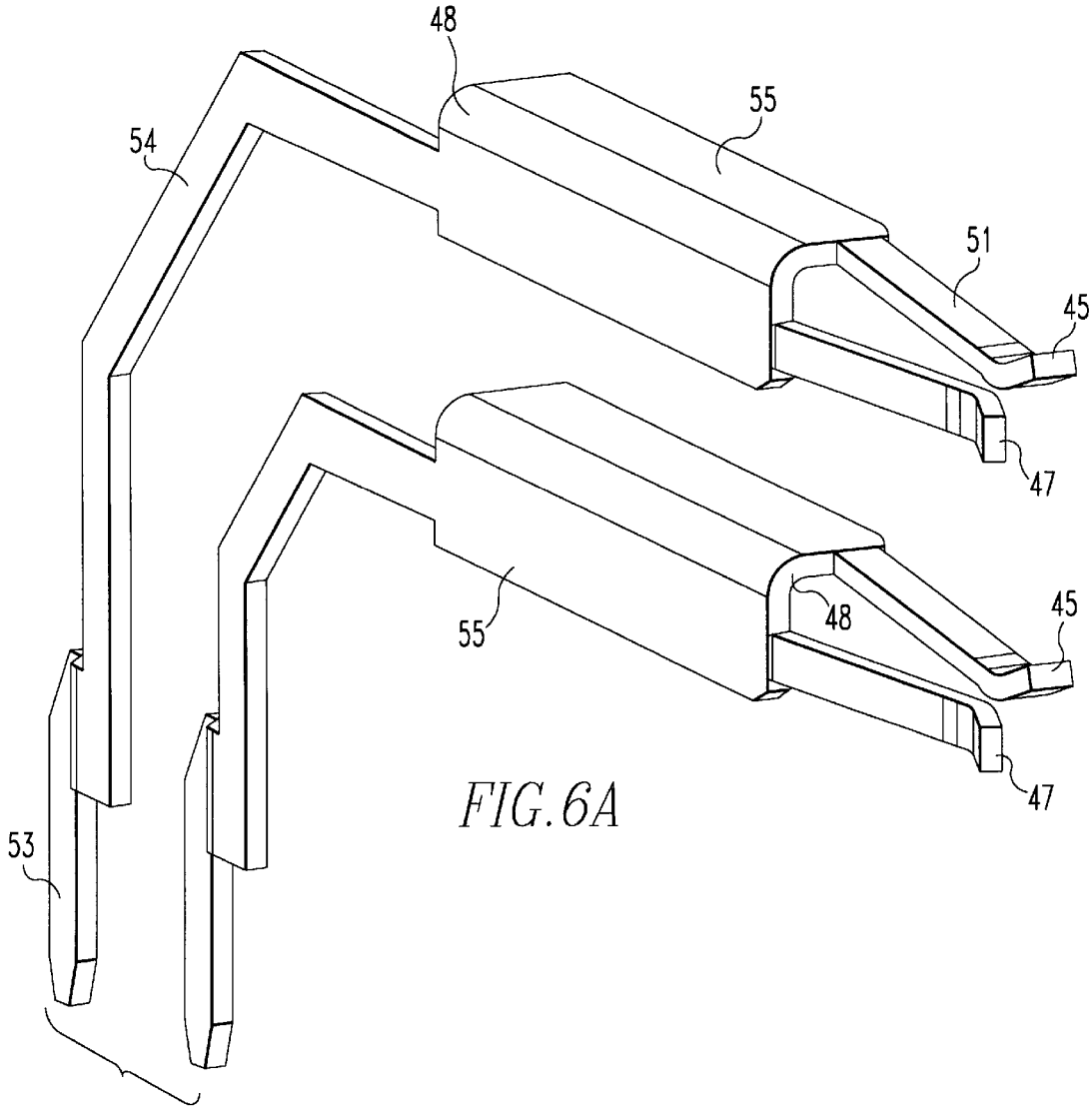
FIGS. 6A and 6B are perspective views of an exemplary signal receptacle contact in accordance with the present invention.
Figure 6B:
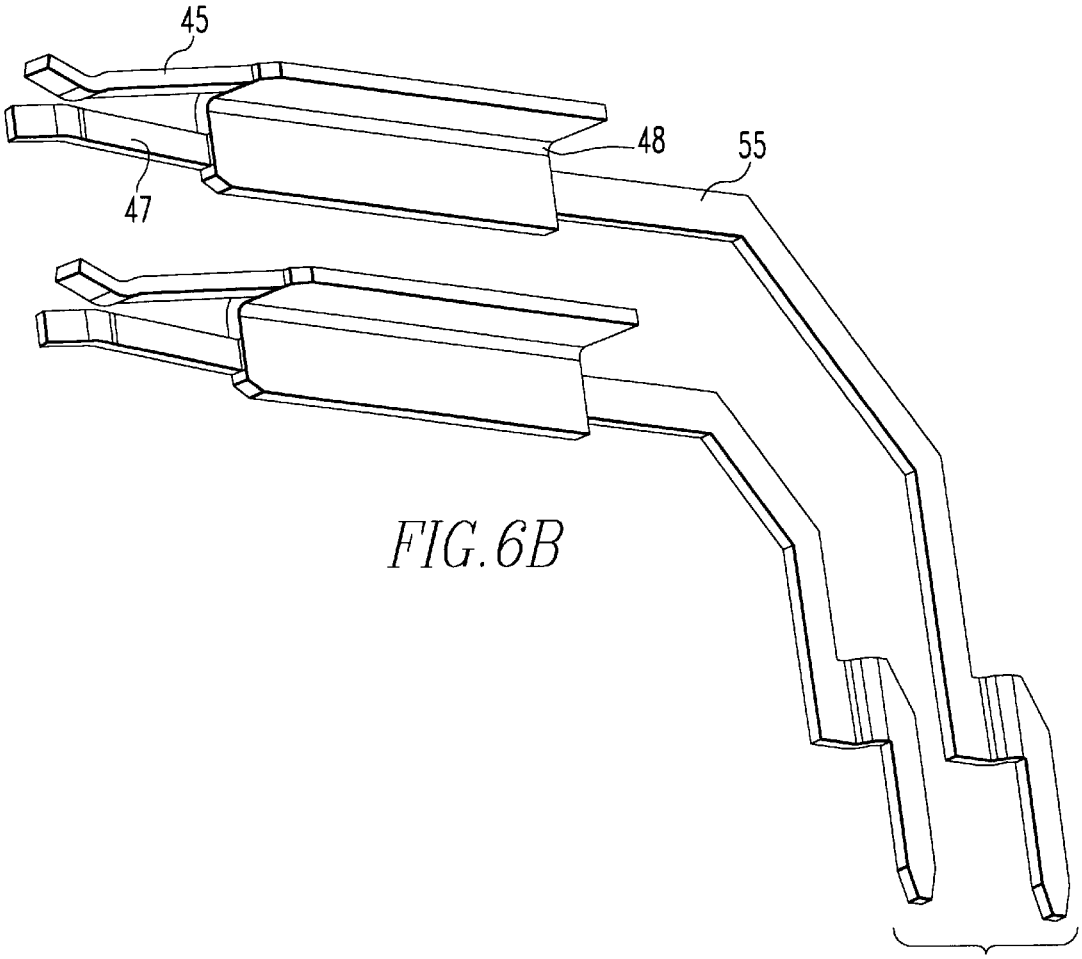

FIGS. 6A and 6B are perspective views of an exemplary signal receptacle contact in accordance with the present invention. The signal receptacle contact 55 is preferably an L-shaped structure 48 having two contact points 45 and 47 to contact the signal.pin 15. The signal receptacle contact 55 of the socket connector is provided, on the front end thereof, with a portion 51 that can mate with the associated pin of the header connector, on the intermediate portion, with a right angle portion 54 having a square sectional shape, and on the securing or rear end portion thereof, with a terminal 53, respectively.

Figure 7A:
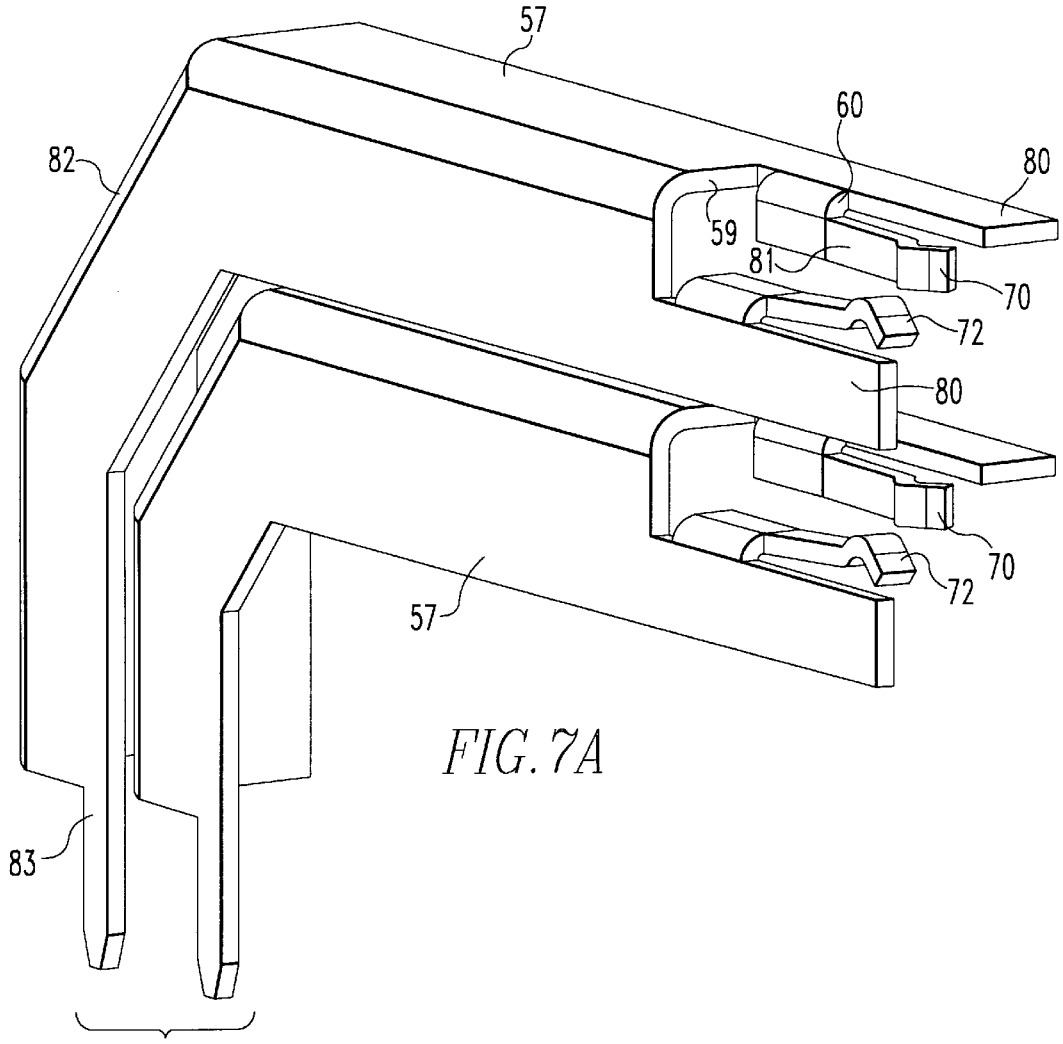
FIGS. 7A and 7B are perspective views of an exemplary ground receptacle contact in accordance with the present invention.
Figure 7B:
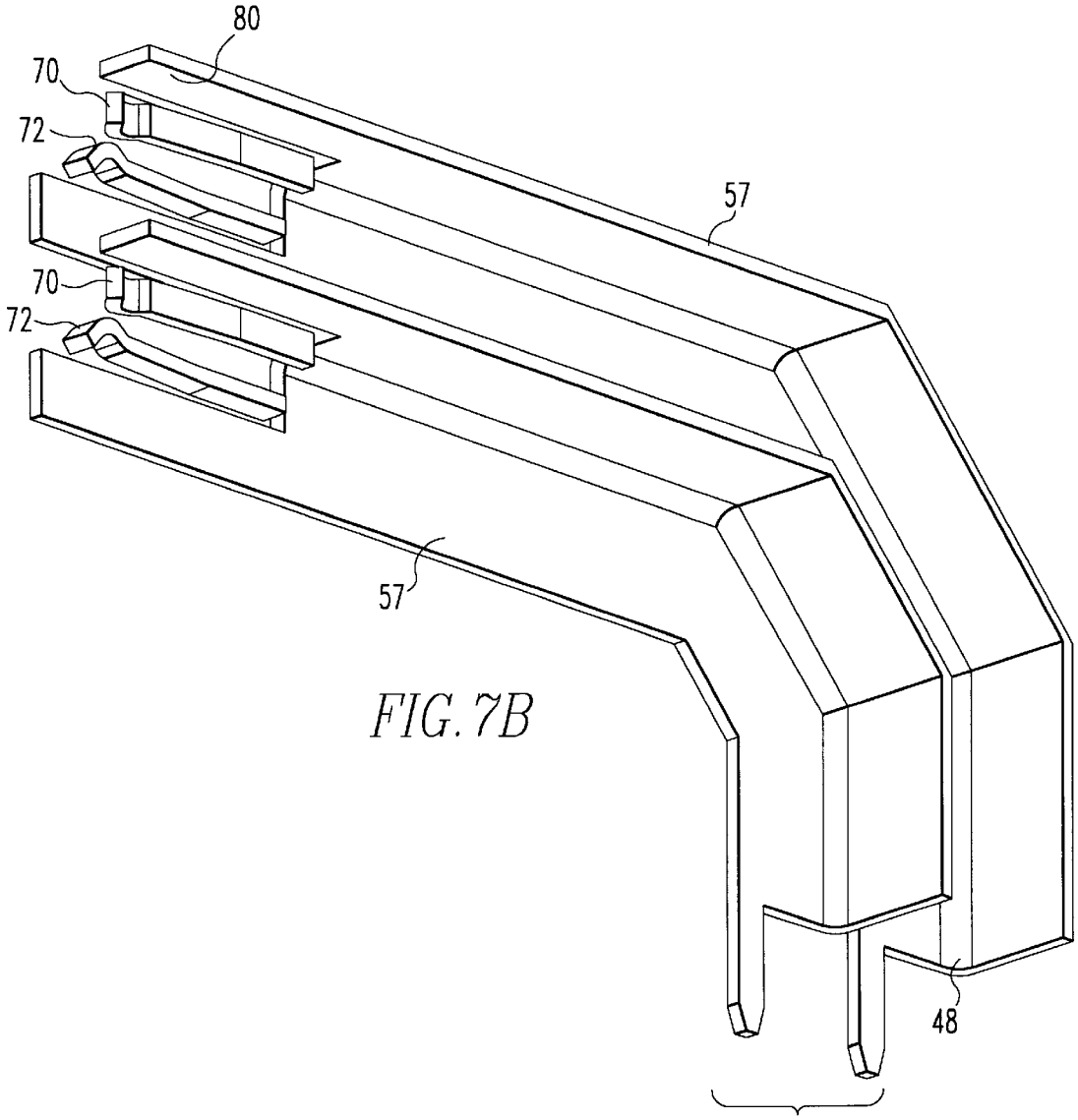

FIGS. 7A and 7B are perspective views of an exemplary ground receptacle contact in accordance with the present invention. The ground receptacle contact 57 is preferably L-shaped to receive an L-shaped pin (e.g., the ground pin 17). Two contact points 70 and 72 are provided to contact the L-shaped pin. Shaped or punched sections 59 and 60 of the ground receptacle contact 57 are also shown. Orthogonal shielding tabs 80 are provided on the ground receptacle contact 57 to provide electromagnetic shielding. The ground receptacle contact 57 of the socket connector is provided, on the front end thereof, with a portion 81 that can mate with the associated pin of the header connector, on the intermediate portion, with a right angle portion 82 having a square sectional shape, and on the securing or rear end portion thereof, with a terminal 83, respectively.

Figure 8A:
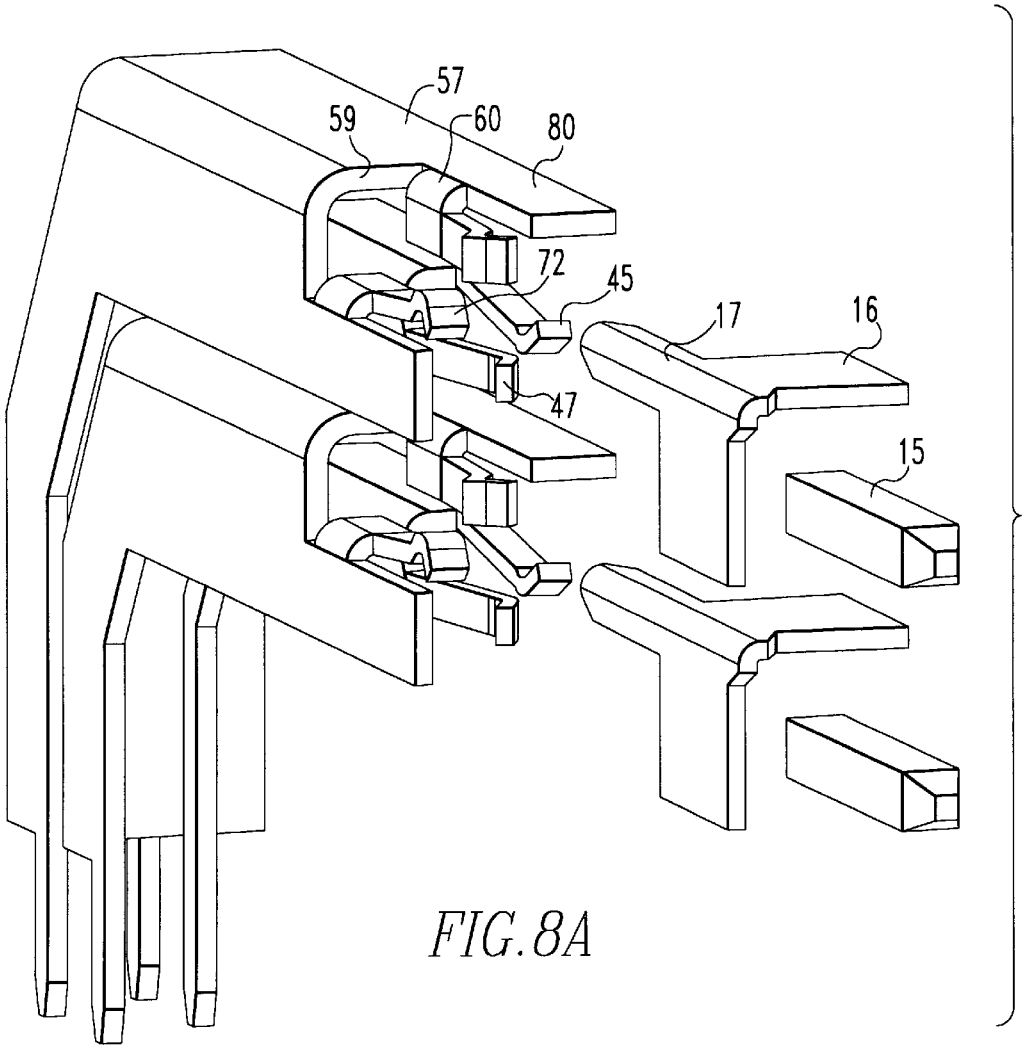
FIGS. 8A and 8B are perspective views of a pair of exemplary socket connectors with associated signal and ground pins in accordance with the present invention.
Figure 8B:
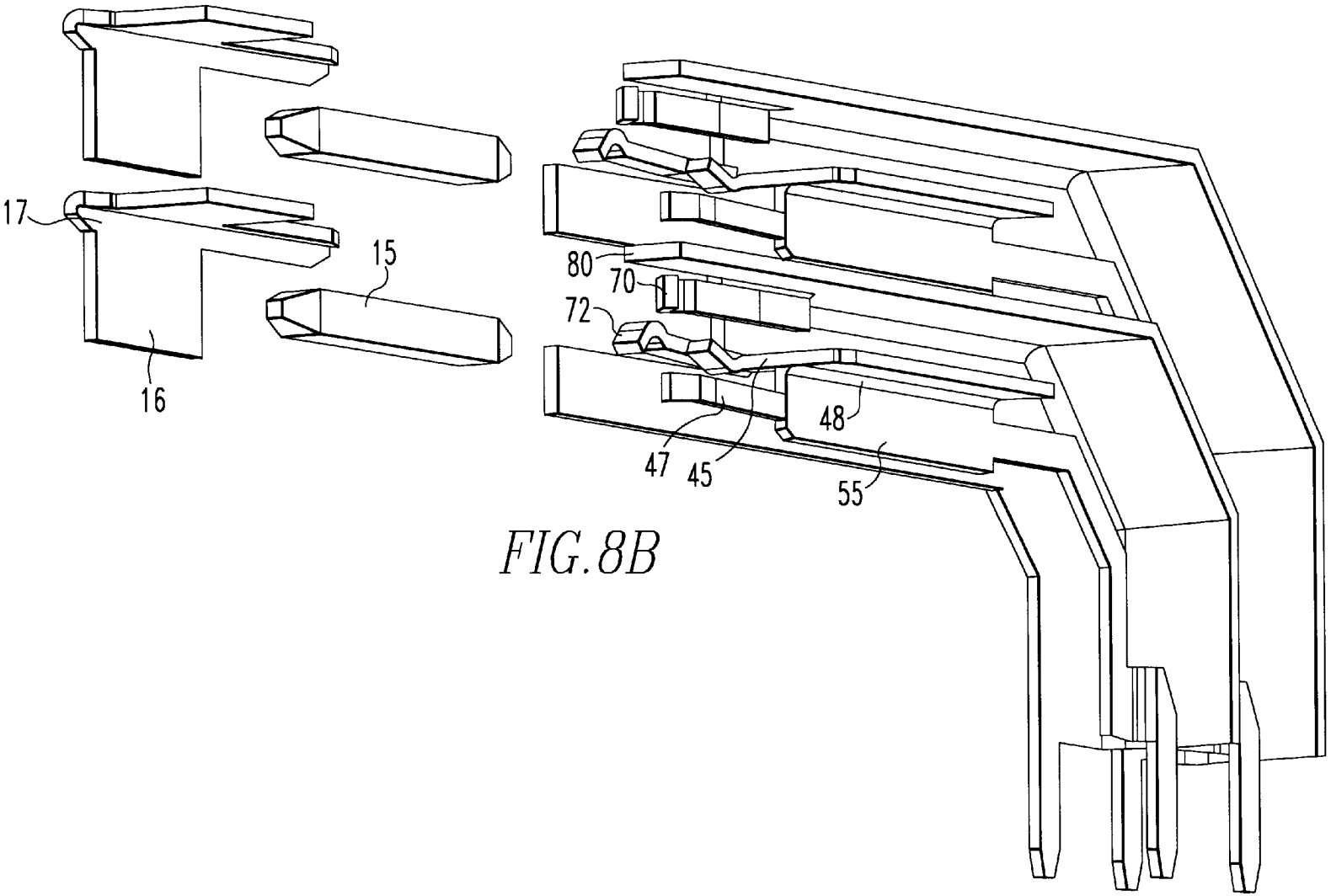

FIGS. 8A and 8B are perspective views of a pair of exemplary socket connectors in accordance with the present invention. FIGS. 8A and 8B combine a pair of the signal receptacle contacts 55 of FIGS. 6A and 6B with a pair of the ground receptacle contacts 57 of FIGS. 7A and 7B. Also shown are the pins 17 and of FIGS. 4 and 5, respectively.

By bringing the header connector 10 and the socket connector 50 together, the motherboard is connected to the daughterboard. The ground pin 17 and the signal pin 15 engage the ground receptacle contact 57 and a signal receptacle contact 55, respectively, at the contact points 70 and 72 and 45 and 47, respectively, to provide electrical isolation in the diagonal direction to other signal contacts that are within the connector module in the contact engagement area.

Figure 9:
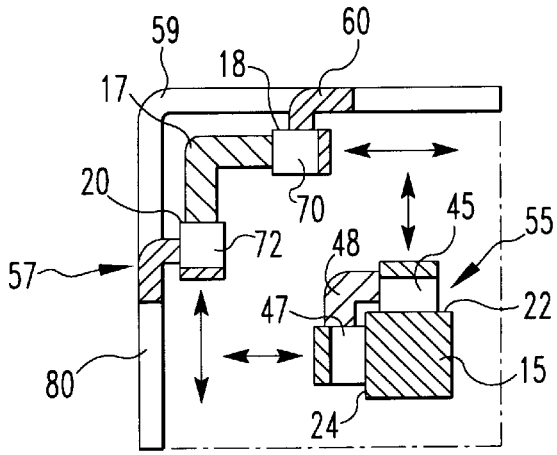
FIG. 9 shows a cross-sectional view of an exemplary connector module in accordance with the present invention.

FIG. 9 shows a cross-sectional view of an exemplary connector module in accordance with the present invention. With respect to the signal receptacle contact 55, the contact points 45 and 47 mate on adjacent sides 22 and 24 of the signal pin 15, which preferably has a rectangular cross-section, and not on opposing sides of the signal pin 15. With respect to the ground receptacle contact 57, the contact points 70 and 72 mate on ends 18 and 20 of the L of the L-shaped ground pin 17. The mating scheme provides more room to surround the signal with a ground. A signal is carried from the ground of the header connector to the socket connector on one pin (i.e., the L-shaped ground pin 17) to provide two points of contact. This gives electrical isolation in a condensed area.

Figure 10A:
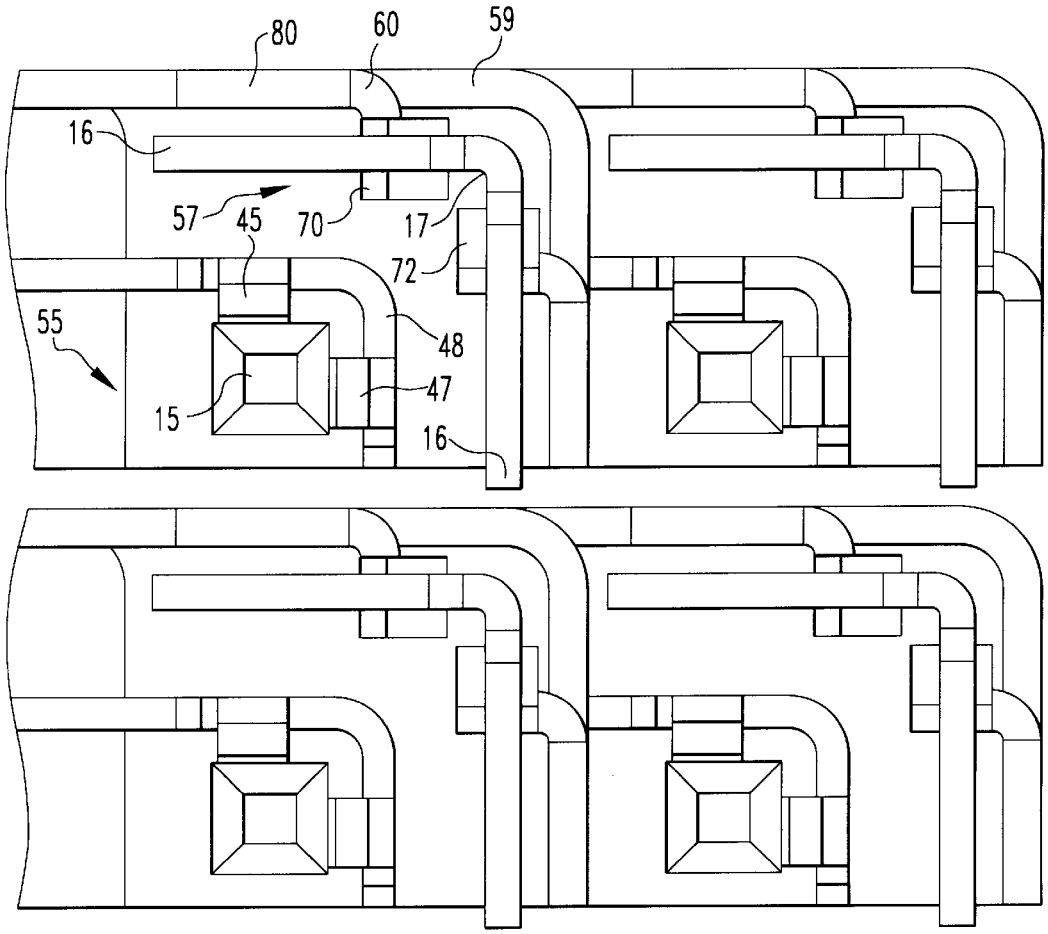
FIG. 10A shows an array of exemplary connector modules in accordance with the present invention.

A plurality of row and columns of the contacts of the connector modules can be regularly arranged in a closely spaced array. The preferable pitch is 22 mm, and preferably a signal contact column is interposed between two adjacently located ground contact columns. FIG. 10A shows an array of four exemplary connector modules in accordance with the present invention. Each signal pin 15 is shielded by the ground receptacle contact 57 in its connector module, as well as the ground receptacle contacts 57 in neighboring modules. Although four connector modules are shown arrayed in FIG. 10A, it should be noted that any number of connector modules can be arrayed.

The moment of inertia of an L-shaped cross-section pin during bending is much greater than that of a conventional blade. Therefore, the L-shaped cross-section of ground pin 17 provides a mechanical advantage over a blade shape of a similar thickness by increasing the overall flexural stiffness of the pin cross-section, where flexural stiffness is defined at the product of Young's Modulus (E) and the moment of inertia (I), or flexural stiffness=E×I. This stiffness is important in reducing the potential for pin deformation during engagement. It should also be noted that this increase in stiffness is achieved in a more material-efficient manner with an L-shaped pin than if a pin with a square or round cross-section of similar width were used.

The exemplary embodiment allows flexing-plane orientation clearances to be implemented in a more compact manner. Additionally, the "side-ways" 90° beam engagement of the ground receptacle contact 57 is preferably disposed in a reversed orientation with respect to the signal receptacle contact 55. In other words, the offset orientation of the signal receptacle contact 55 is opposite to that of the ground receptacle contact 57. The compact 90° opposing signal and ground beam configuration of the present invention helps balance reaction forces. The reversed orientation generates contact engagement reaction forces from the signal and ground receptacle contacts 55 and 57 that are generally opposed to each other and are preferably arranged to cancel each other out rather than being cumulative. A one-directional, cumulative effect of reaction forces during connector mating has the potential to generate undesirable "twisting" or torque forces that could damage printed circuit boards. The present invention preferably has two of the beams or contact points flex in a first flexing plane, for example, the vertical flexing plane, and two other beams or contact points flex in a second flexing plane, for example, the horizontal flexing plane. In other words, one of the two contact points 70 and 72 flexes in a first direction, and the other contact point 70 and 72 flexes in a second direction, where the second direction is preferably perpendicular to the first direction. Moreover, one of the two contact points 45 and 47 flexes in a third direction, and the other contact point 45 and 47 flexes in a fourth direction. The third direction is opposite the first direction and the fourth direction is opposite the second direction. Therefore, the forces in the first and third directions are generally opposed to each other and are preferably arranged to cancel each other out, and the forces in the second and fourth directions are generally opposed to each other and are preferably arranged to cancel each other out cancel each other out. Thus, the reaction forces are minimized.

Figure 10B:
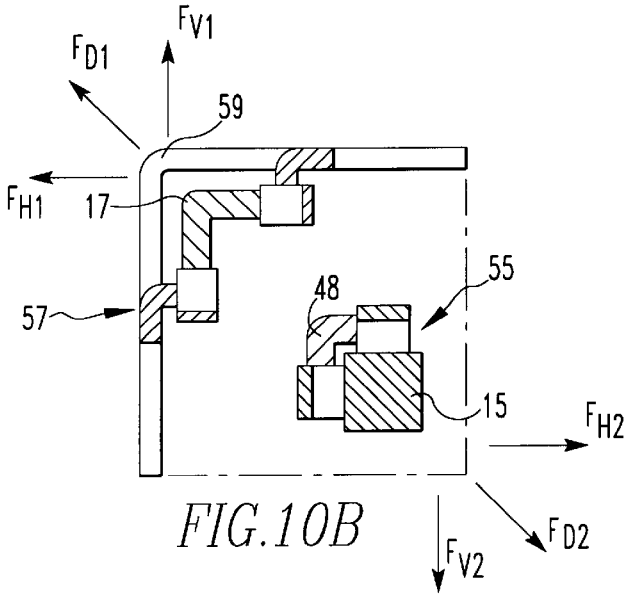
FIG. 10B shows a free body diagram of an exemplary connector module in accordance with the present invention.

More specifically, the connector module in accordance with the present invention can achieve a balance of forces, as shown in the free body diagram of FIG. 10B. The ground receptacle contact 57 contacts the ground pin 17, thereby generating a first set of forces represented by vectors $F_{H1}$ and $F_{V1}$ in the horizontal and vertical directions, respectively. The forces act on the connector module and combine to create a first resultant force represented by vector $F_{D1}$ in a resultant direction, preferably diagonal to the contact 57. Another force is developed by the signal receptacle contact 55 on the signal pin 15, thereby generating a second set of forces represented by vectors $F_{H2}$ and $F_{V2}$ in the horizontal and vertical directions, respectively. The forces act on the connector module and combine to create a second resultant force represented by vector $F_{D2}$ in a resultant direction, preferably diagonal to the contact 55. The forces are developed as a result of the interaction of the ground and signal contacts with the ground and signal pins. Preferably, the vectors $F_{D1}$ and $F_{D2}$ are in opposite, diagonal directions, and they have equal magnitude, thus offsetting each other and ultimately balancing the connector. For example, one vector points in the northwest direction, and the other vector points in the southeast direction. Thus, the present invention balances forces using the ground and signal contacts in conjunction with the ground and signal pins. These vectors preferably balance each other in a diagonal direction.

Figure 11:
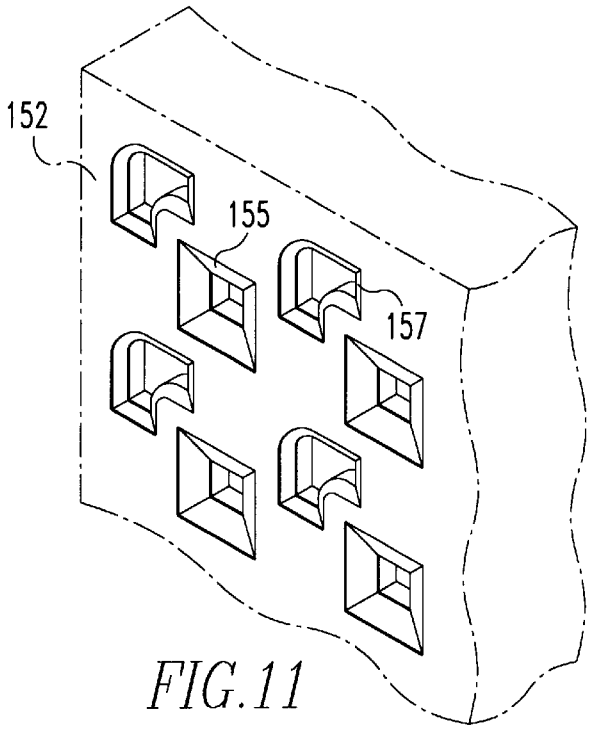
FIG. 11 shows an exemplary socket receptacle housing in accordance with the present invention.

FIG. 11 shows an exemplary socket receptacle housing in accordance with the present invention. The socket receptacle housing 152 is preferably comprised of plastic and covers the signal receptacle contacts and the ground receptacle contacts. Windows 155 and 157 are provided to receive the signal and ground pins, respectively, from the header connector.

Figure 12:
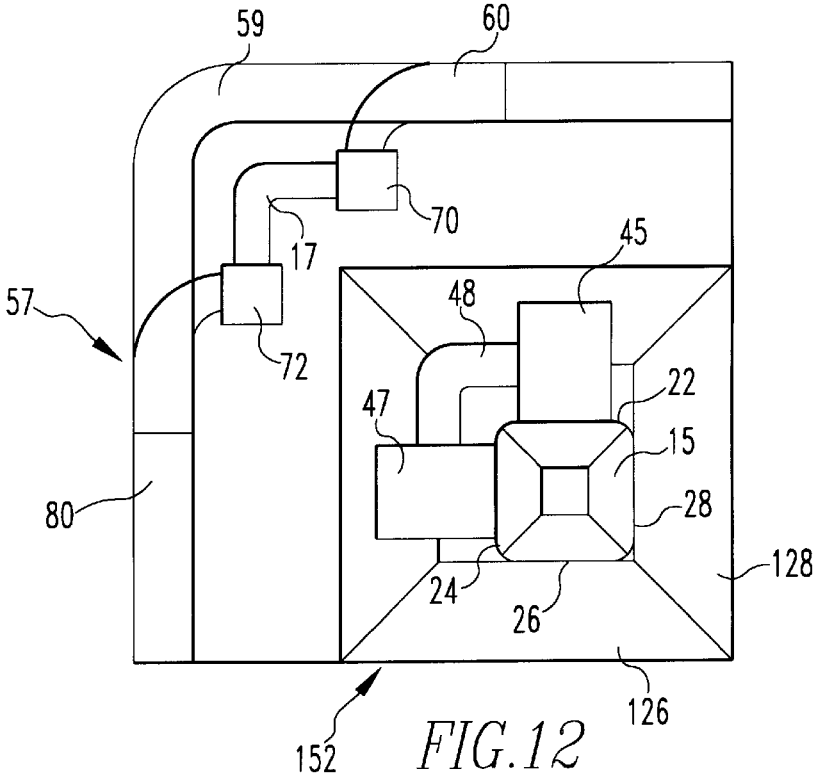
FIG. 12 shows a cross-sectional view of an exemplary connector module with a socket receptacle housing in accordance with the present invention.

FIG. 12 shows a cross-sectional view of an exemplary connector module with a socket receptacle housing in accordance with the present invention. FIG. 12 is similar to FIG. 9 and contains elements similar to those described above with respect to FIG. 9. These elements are labeled identically and their description is omitted for brevity. The signal pin 15 is supported on two sides 26, 28 by sidewalls 126, 128, respectively, of the socket receptacle housing 152. Forces are generated by the housing 152 to balance the structure and reduce the negative impact of cumulative forces. Because of the contact with the sidewalls 126, 128, a less stiff signal pin can be used in the connector while maintaining balanced reaction forces and avoid undesirable twisting or torque forces.

In accordance with a second embodiment of the present invention, a high-performance backplane connector system that can be used for differential pair electrical signaling is provided. Moreover, row-based pairing is implemented. A mirror geometry between adjacent connector columns is described in which row-based differential pair alignment between adjacent columns of signal pins is achieved. Row-based differential pairing is preferable in a connector because it does not create signal skew timing problems, as in column-based pairing. The true and complement signals of a row-based differential pair have no skew because they travel substantially identical electrical lengths through the same row connector and therefore do not have skew-related problems. The use of differential pairs improves the signal integrity, thus canceling common mode interference. Higher signal speeds can be used without adversely affecting crosstalk. Row-based pairing also eliminates the need for skew compensation in the board design.

The second embodiment of the present invention incorporates a header connector ground pin, preferably two piece, that provides a tail for connection to a printed circuit board and preferably dual ground contact mating pins, preferably L-shaped, for engaging with corresponding socket connector ground contacts. The header ground contact system provides for dedicated 1:1 signal/grounding path connections to the printed circuit board in conjunction with a mirrored-column differential pair approach in a manner that reduces the number of grounding through-holes on the board, thereby improving printed circuit board trace routablility while achieving vertical and horizontal signal shielding. Because the ground and signal contacts are disposed in a paired mirror relationship, the number of ground pins that is used is decreased, preferably by one-half.

Figure 13A:
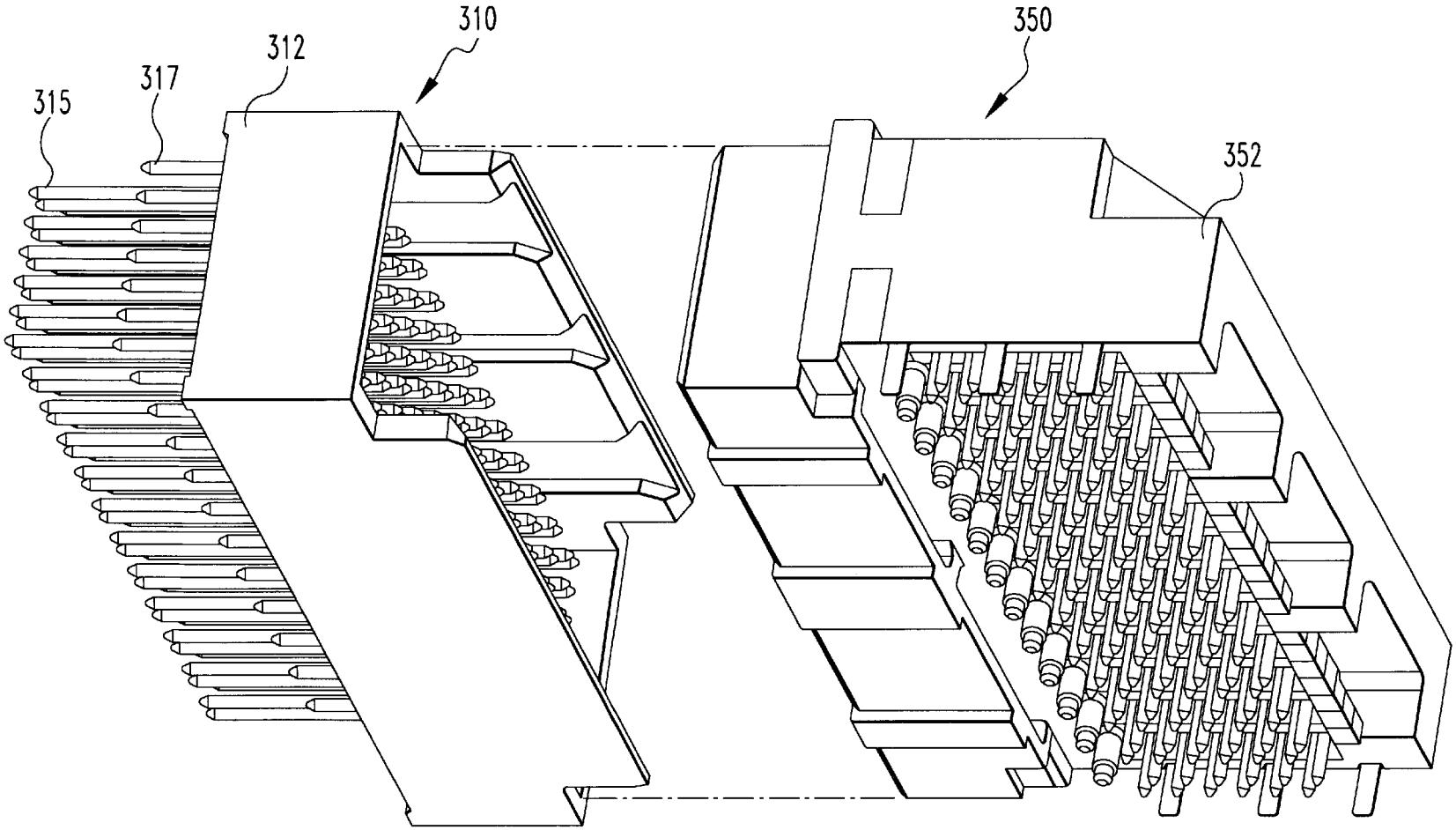
FIG. 13A is sectional perspective view of another exemplary connector in accordance with the present invention.

The second embodiment of a connector in accordance with the present invention is shown in FIG. 13A as a sectional perspective view. A straight type of header connector 310 is comprised of a header housing 312 and pins (male contacts) 315 for a signal transmission line and pins (male contacts) 317 for a ground line. These pins 315 and 317 are regularly arranged in a plurality of rows on the header housing 312 of the associated connector 310. The housing is preferably molded, using a plastic material such as a high temperature thermoplastic. The pins are preferably stamped and formed with the preferred material being phosphor bronze or beryllium copper. The header connector 310 can be mounted on or connected to a first printed card, called a motherboard. A right angle type of socket connector 350 is comprised of a receptacle housing 352, signal receptacle contacts (shown as 355 in FIG. 16A, similar to contacts 55 in the first embodiment) for a signal transmission line, and ground receptacle contacts (shown as 357 in FIG. 16D, similar to contacts 57 in the first embodiment) for a ground line. A plurality of rows of the contacts 355 and 357 are regularly arranged so as to correspond to those of the header connector 310. The socket connector 350 can be connected to or mounted on a second printed card, called a daughterboard. The housing 352 is preferably molded, using a plastic material such as a high temperature thermoplastic. The contacts are preferably stamped and formed of beryllium copper or phosphor bronze.

Figure 13B:
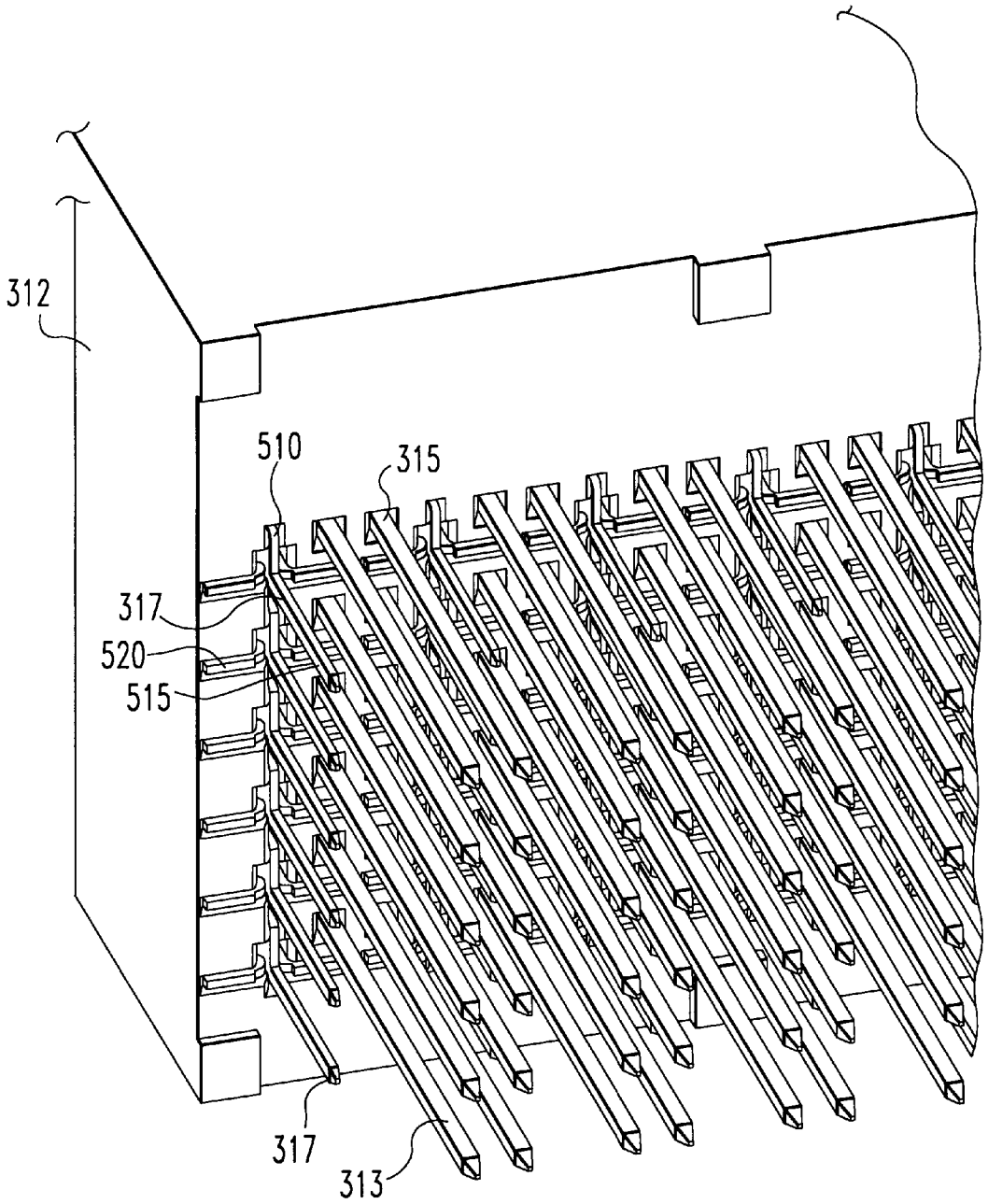
FIG. 13B shows a preferred arrangement of the ground and signal pins in the connector of FIG. 13A.

FIG. 13B shows a preferred arrangement of the pins 315 and 317 in the header housing 312. FIG. 13B shows the portions of the pins 315 and 317 that do not plug into the contacts 355 and 357, but rather plug into, for example, a motherboard. There is one row of ground pins 317 for every two rows of signal pins 315. This is because of the mirror pair relationship of the connectors, as is described in more detail below. Also shown in FIG. 13B are the portions 510 and 520 of the ground pin 317. These portions 510 and 520 are described in further detail with respect to FIGS. 1SA and 15B. Because only one row of ground pins 317 is used for every two rows of signal pins 315, the number of grounding throughholes is reduced, leading to a less complex, more easily traceable module.

Figure 13C:
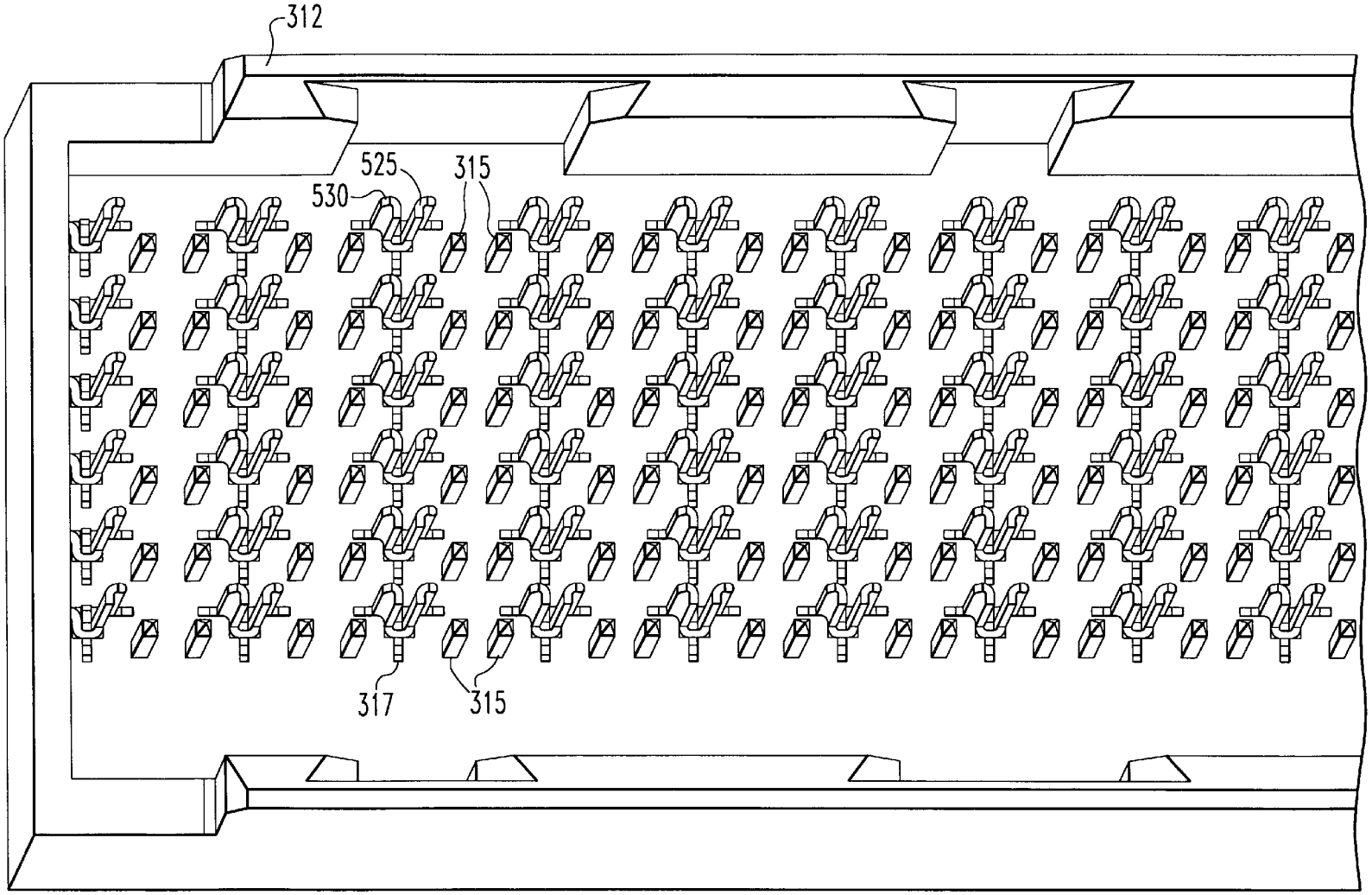
FIG. 13C shows a further view of the preferred arrangement of the ground and signal pins in the connector of FIG. 13A.

FIG. 13C shows a further view of the preferred arrangement of the ground and signal pins in the connector of FIG. 13A. FIG. 13C shows the portions of the pins 315 and 317 that plug into the contacts 355 and 357. Also shown in FIG. 13C are the L-shaped pins 525 and 530 of the ground pin 317. Each of these pins 525, 530 plugs into an associated ground receptacle contact 357. As shown, the pins 525, 530 are disposed in a mirror pair relationship, and as described below in further detail with respect to FIGS. 15A and 15B, the pins 525, 530 are provided from one ground pin 317, thus reducing circuit complexity.

Figure 14:
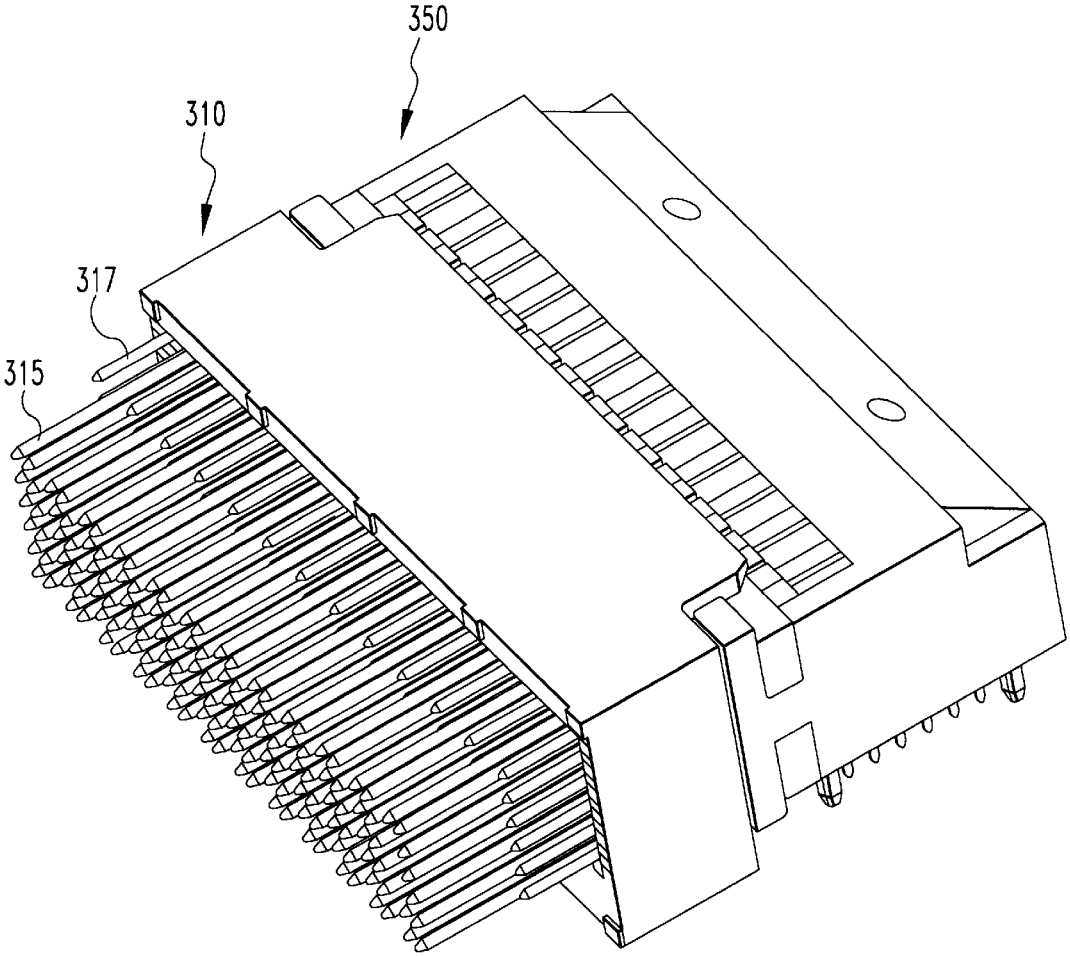
FIG. 14 is a perspective view of the connector of FIG. 13A with the parts assembled.

FIG. 14 is a perspective view of the connector of FIG. 13A with the parts assembled. A plurality of the connectors of FIG. 14 can be arranged in a housing in an array pattern, similar to that shown in FIG. 2.

FIG. 3, described above, shows a perspective view of an exemplary connector module in accordance with the present invention. It should be noted that only an L-shaped end portion of the ground pin 317 is shown in FIG. 3 as element 17. This portion corresponds to portion 530, for example, of FIG. 15A.

Figure 15A:
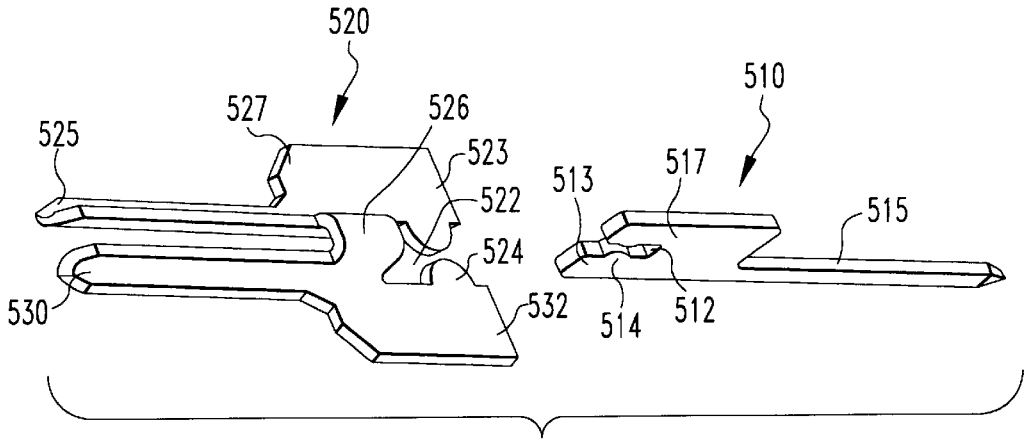
FIG. 15A is a perspective view of another exemplary ground pin in accordance with the present invention, with the parts separated.
Figure 15B:
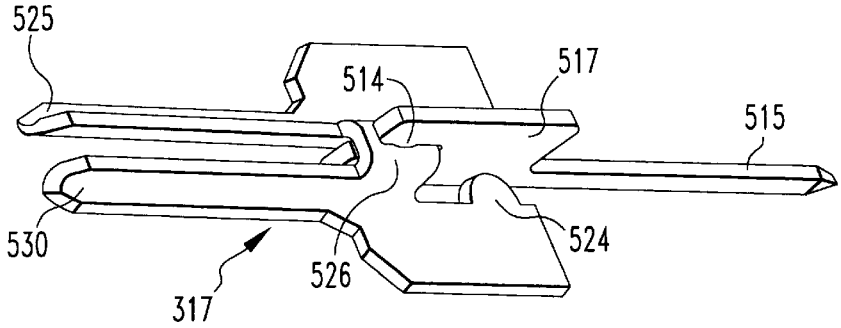
FIG. 15B is a perspective view of the pin of FIG. 15A with the parts assembled.
Figure 15C:
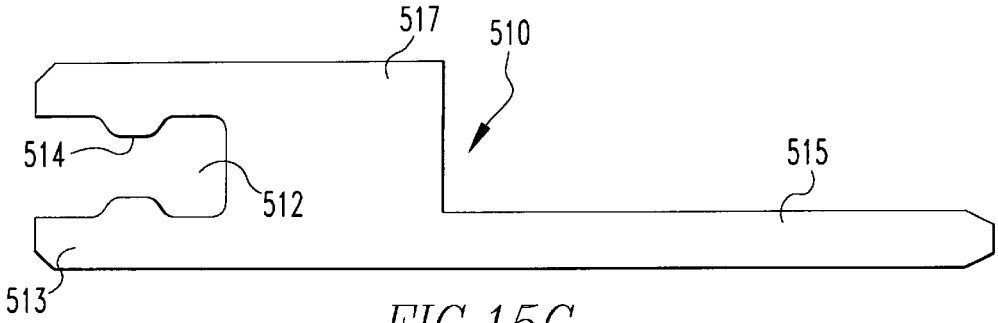
FIG. 15C is a side view of a contact section of the ground pin of FIG. 15A.

FIG. 15A is a perspective view of an exemplary ground pin of the present embodiment in accordance with the invention, with the parts separated, and FIG. 15B is a perspective view of the pin of FIG. 15A with the parts assembled. The ground pin 317 is preferably a two piece system comprising a first contact section 510 and a second contact section 520; however, the ground pin can be formed of only one piece or more than two pieces. As shown in further detail in FIG. 15C, the contact section 510 has a notch 512 with protrusions 513. Each of the protrusions 513 preferably has a raised portion or bump 514. The contact section 520 has a notch 522 with protrusions 523. Each of the protrusions 523 preferably has a raised portion or bump 524. The contact sections 510 and 520 are preferably coupled by the cooperation of protrusions and bumps 513, 514, 523, and 524, as shown in FIG. 15B. The bumps 514 contact a portion 526 of the contact section 520 while the bumps 524 contact a portion of the plate 517 of the contact section 510.

The contact section 510 has a tail 515 which extends from the base of the header connector to a motherboard, for example, and a plate 517. The contact section 520 has preferably two cross-sectionally L-shaped pins 525, 530 extending therefrom and two plates 527, 532 protruding from a side portion of the pins 525, 530. It should be noted that the contact section can comprise only one cross-sectionally L-shaped pin or greater than two cross-sectionally L-shaped pins. The L-shaped pins 525, 530 each plug into an associated ground receptacle contact. Because of the dual L-shaped pins 525, 530, the ground contacts on two socket connectors can be contacted with each header connector ground pin, thereby reducing the number of ground pins by a factor of two. Preferably, the two plates 527, 532 are co-planar. These plates 517, 527, 532 provide isolation and shielding in the header connecter. The L-shape is material-efficient and increases flexural stiffness.

The signal pin 315 in the present embodiment is the same as the signal pin 15 described above with respect to FIG. 5. Each L-shaped pin of the ground pin 317 is preferably located in a diagonal orientation with respect to a signal pin 315.

As in the first embodiment, a socket connector comprises a signal receptacle contact 355 and a ground receptacle contact 357. These contacts are similar to the contacts 55 and 57 in the first embodiment. The receptacle contacts 355 and 357 are preferably a 90° offset dual-beam signal receptacle contact and a 90° offset dualbeam ground receptacle contact, respectively.

Figure 16A:
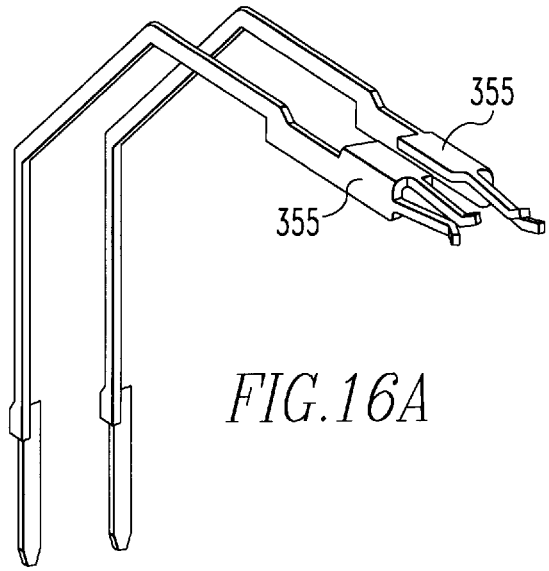
FIG. 16A is a perspective view of a pair of exemplary signal receptacle contacts in a mirror relationship in accordance with the present invention.
Figure 16B:
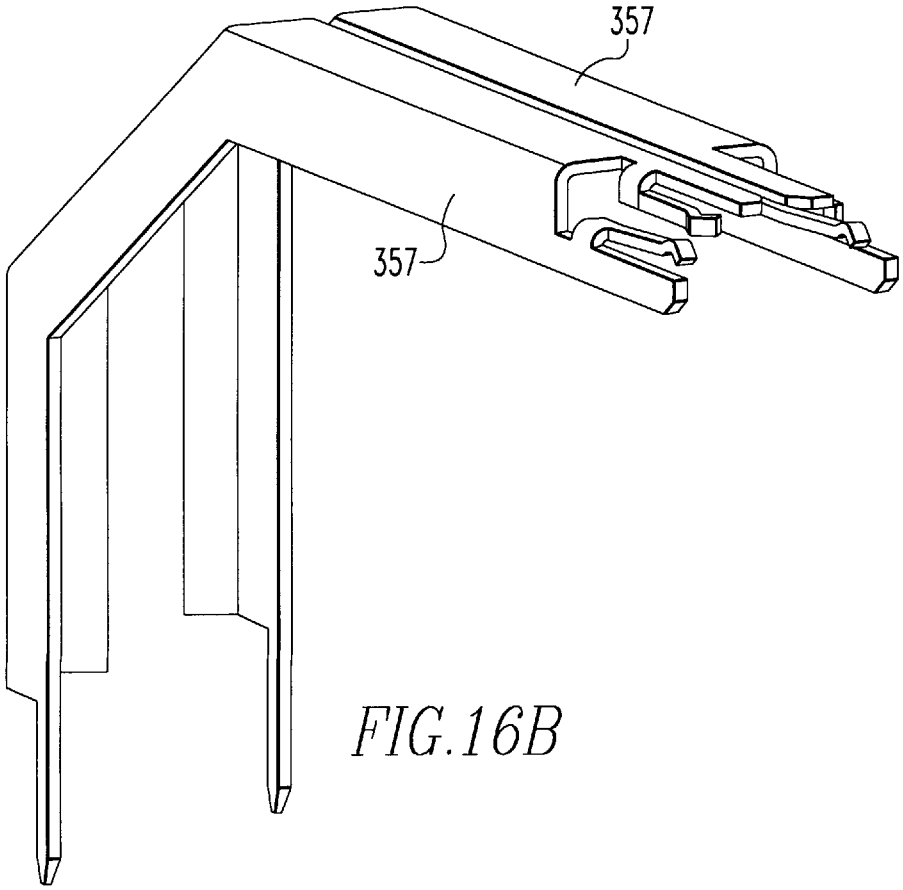
FIG. 16B is a perspective view of a pair of exemplary ground receptacle contacts in a mirror relationship in accordance with the present invention.
Figure 16C:
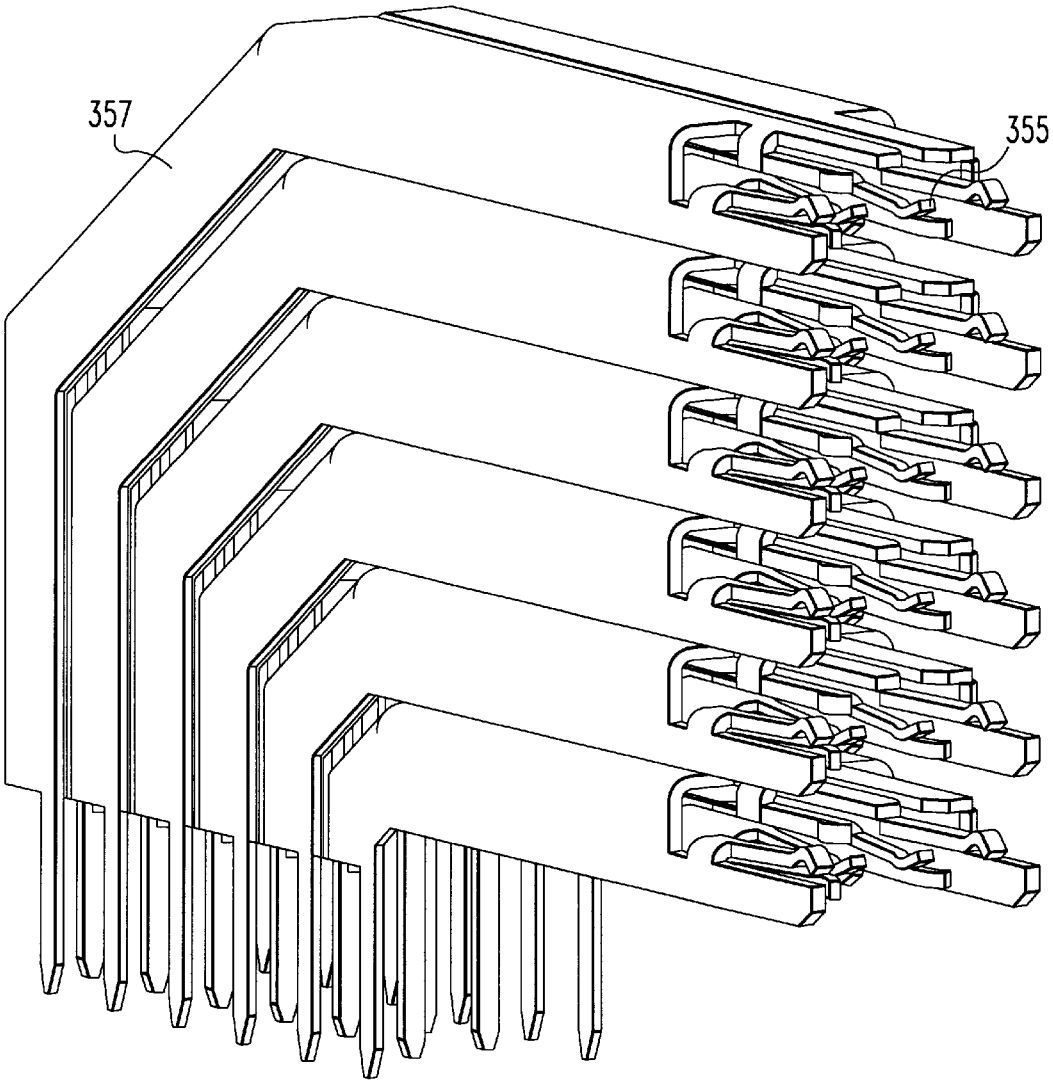
FIG. 16C is a perspective view of exemplary socket connectors arranged in a mirror relationship and an array in accordance with the present invention.

FIG. 16A is a perspective view of a pair of exemplary signal receptacle contacts 355 in a mirror relationship in accordance with the present invention. FIG. 16B is a perspective view of a pair of exemplary ground receptacle contacts 357 in a mirror relationship in accordance with the present invention. Multiple pairs of contacts can be arranged in an array of rows and columns in a connector to provide horizontal and vertical shielding. FIG. 16C is a perspective view of exemplary socket connectors arranged in a mirror relationship and an array of six pairs in accordance with the present invention. The present invention provides row-based pairing. Thus, there is no in pair skew. This reduces electrical timing problems and crosstalk.

Figure 17A:
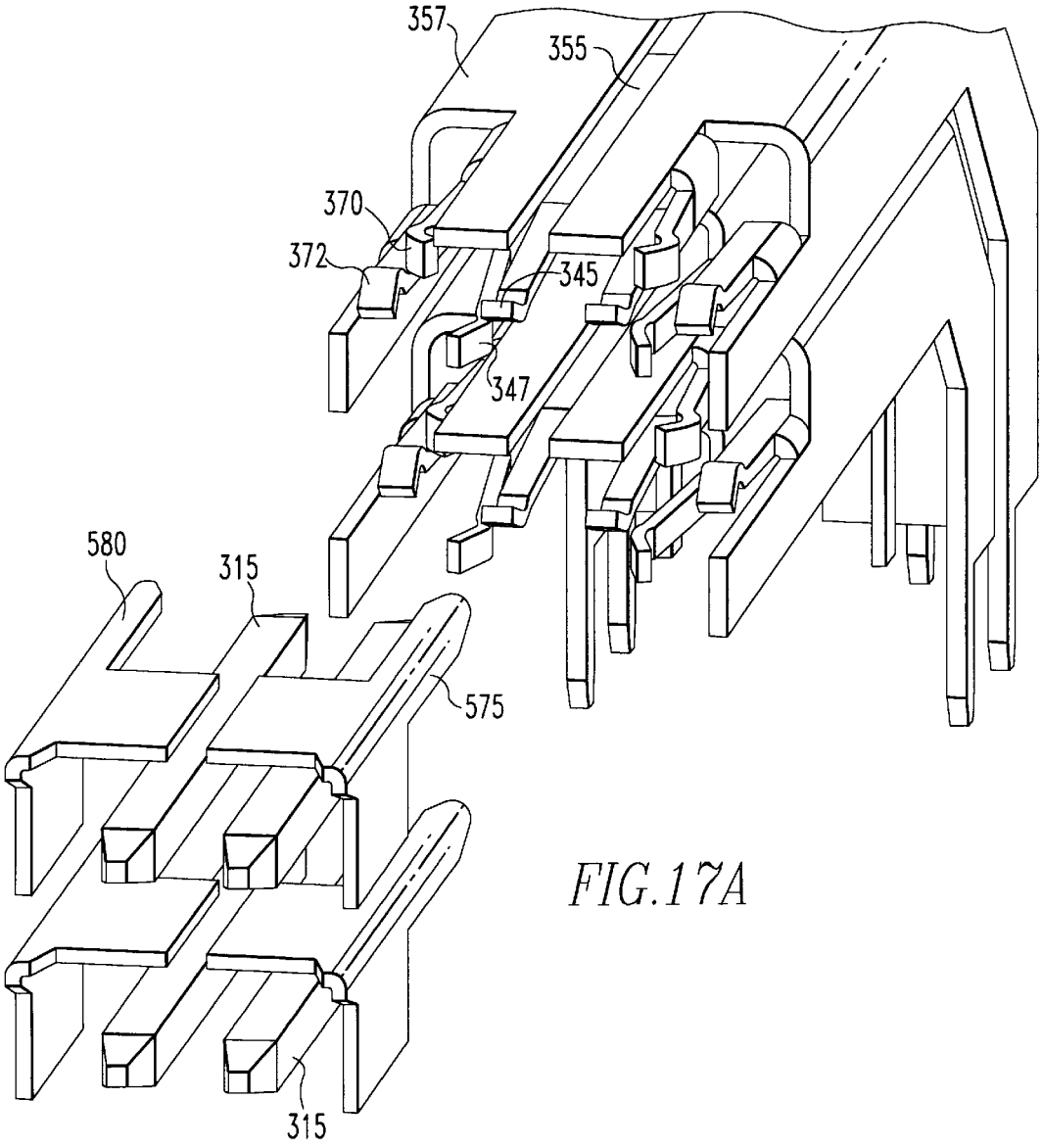
FIGS. 17A and 17B are perspective views of two pairs of exemplary socket connectors with associated signal and ground pins in accordance with the present invention.
Figure 17B:
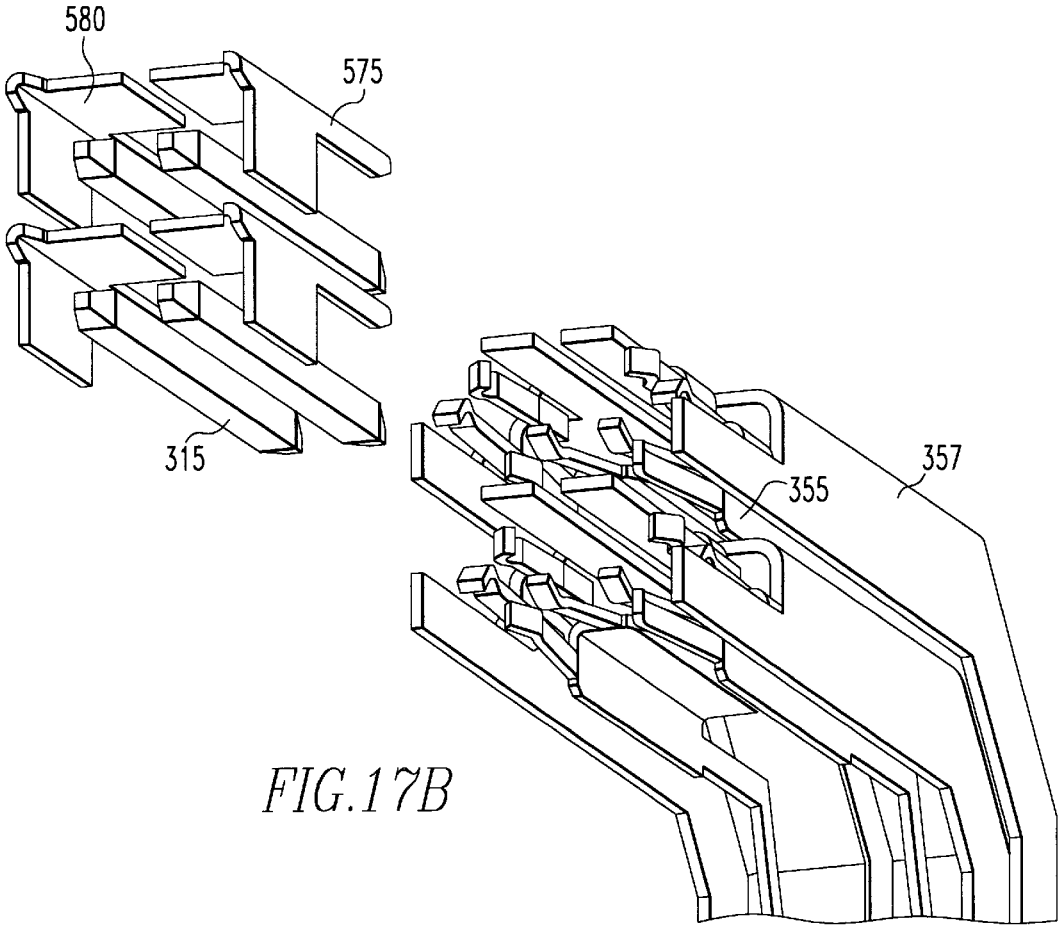

FIGS. 17A and 17B are perspective views of two pairs of exemplary socket connectors in accordance with the present invention. FIGS. 17A and 17B combine the signal receptacle contact 355 of FIG. 16A with the ground receptacle contact 357 of FIG. 16B. Also shown are L-shaped ground pins 575, 580 and the signal pins 315. Ground pins 575 and 580 are L-shaped portions which are disposed in a mirror relationship. The L-shaped ground pins 575, 580 can be associated with the same ground pin, similar to the L-shaped pins 525 and 530 of ground pin 317 shown in FIG. 15A. On the other hand, the L-shaped ground pins 575, 580 can be associated with separate or different ground pins, such as the ground pin 17 shown in FIG. 4.

By bringing the header connector 310 and the socket connector 350 together, the motherboard is connected to the daughterboard. The ground pins 575, 580 and the signal pins 315 engage the ground receptacle contacts 357 and a signal receptacle contacts 355, respectively, at the associated contact points 370, 372, 345, and 347 to provide electrical isolation to other signal contacts that are within the connector module in the contact engagement area.

Figure 18:
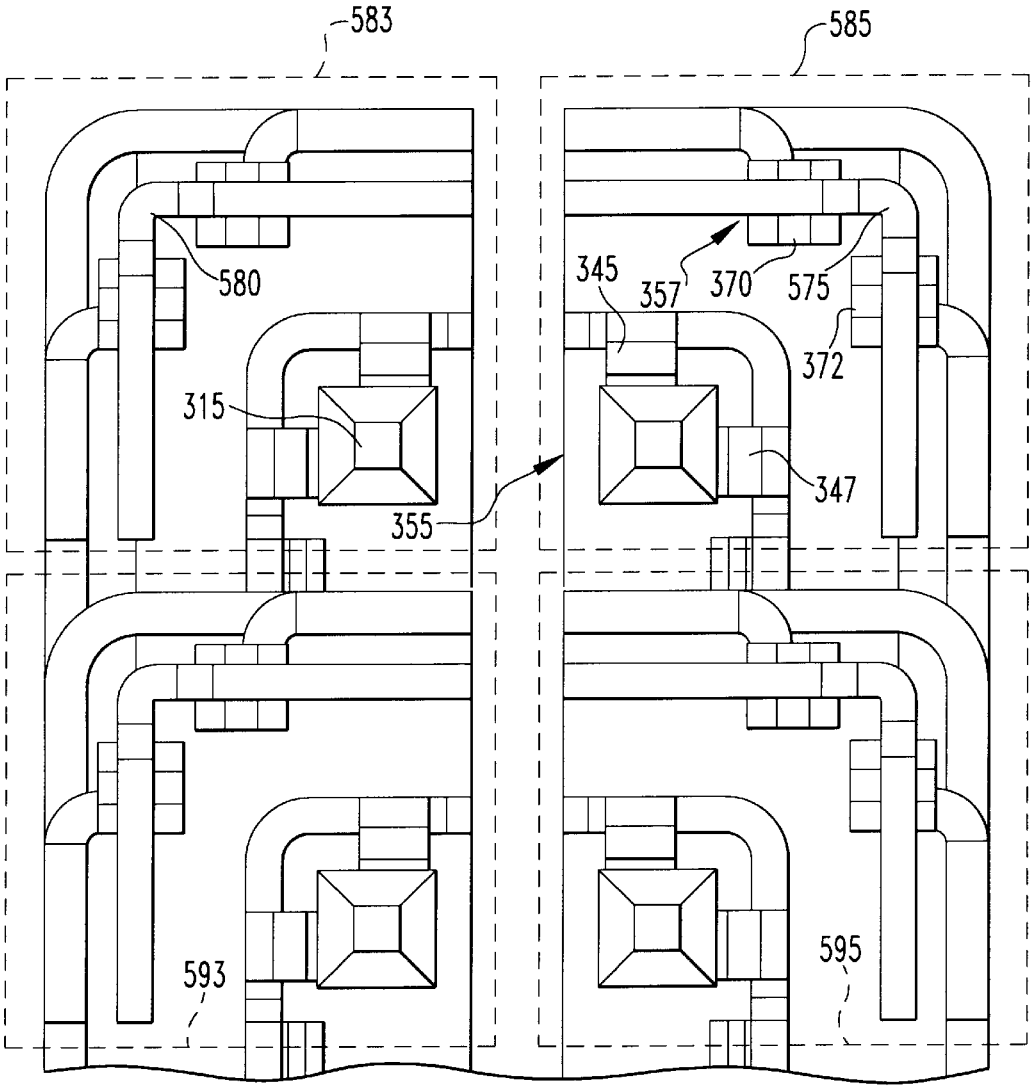
FIG. 18 shows an array of further exemplary connector modules in accordance with the present invention.

A plurality of row and columns of the contacts of the connector modules can be regularly arranged in a closely spaced array. The preferable pitch is 2 mm, and preferably a pair of the connector modules are arranged in a mirror geometry relationship. FIG. 18 shows an array of four exemplary connector modules in accordance with the present invention. The connector module 583 is in a mirror relationship with the connector module 585, and the connector module 593 is in a mirror relationship with the connector module 595. Each signal pin 315 is shielded by the ground receptacle contact 357 in its connector module. Although four connector modules are shown arrayed in FIG. 18, it should be noted that any number of connector modules can be arrayed.

Figure 19:
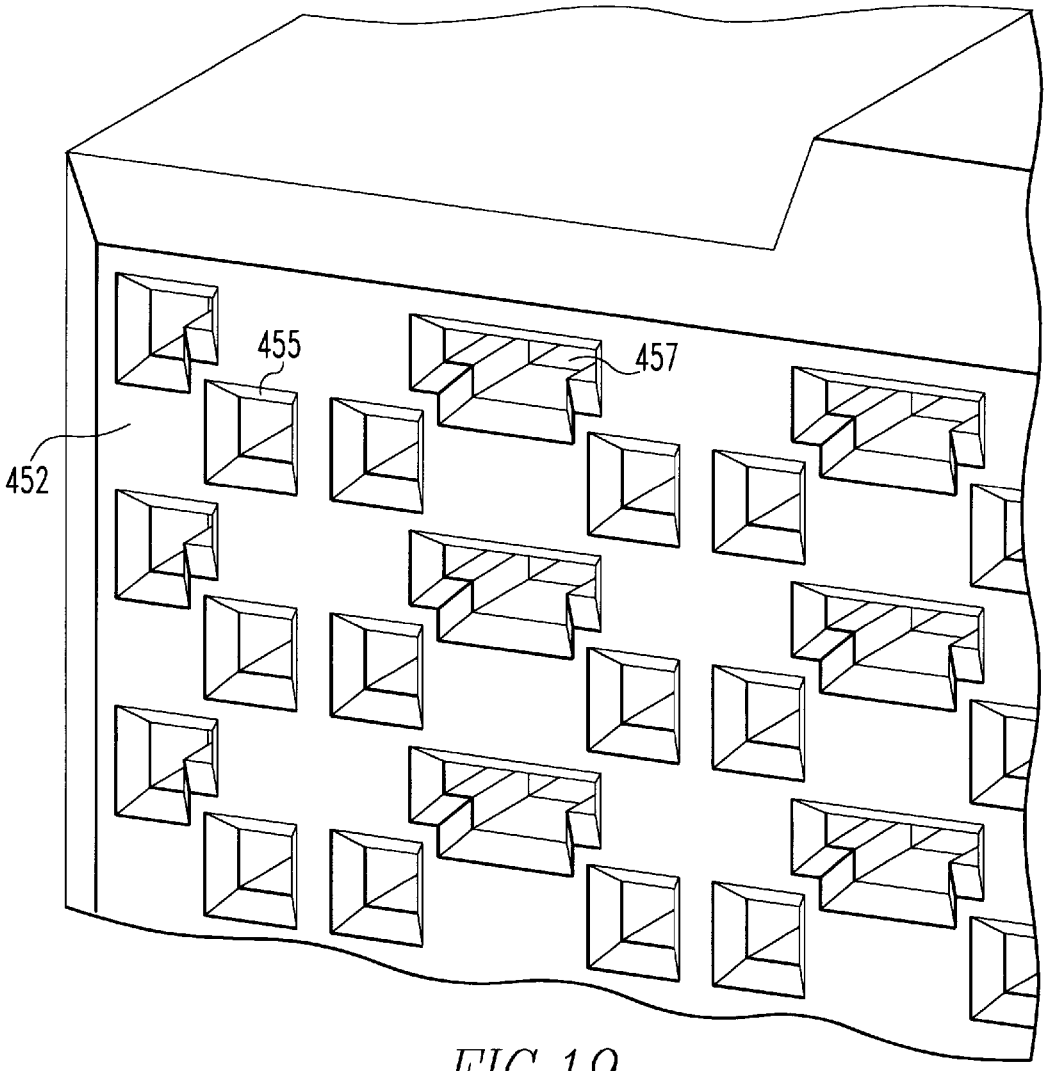
FIG. 19 shows a further exemplary socket receptacle housing in accordance with the present invention.

FIG. 19 shows an exemplary socket receptacle housing in accordance with the present embodiment of the invention. The socket receptacle housing 452 is preferably comprised of plastic and covers the signal receptacle contacts and the ground receptacle contacts. Windows 455 and 457 are provided to receive the signal 315 and ground pins 317 (i.e., L-shaped pins 525 and 530), respectively, from the header connector. The housing 452 is similar to that shown in FIG. 13B.

Figure 20:
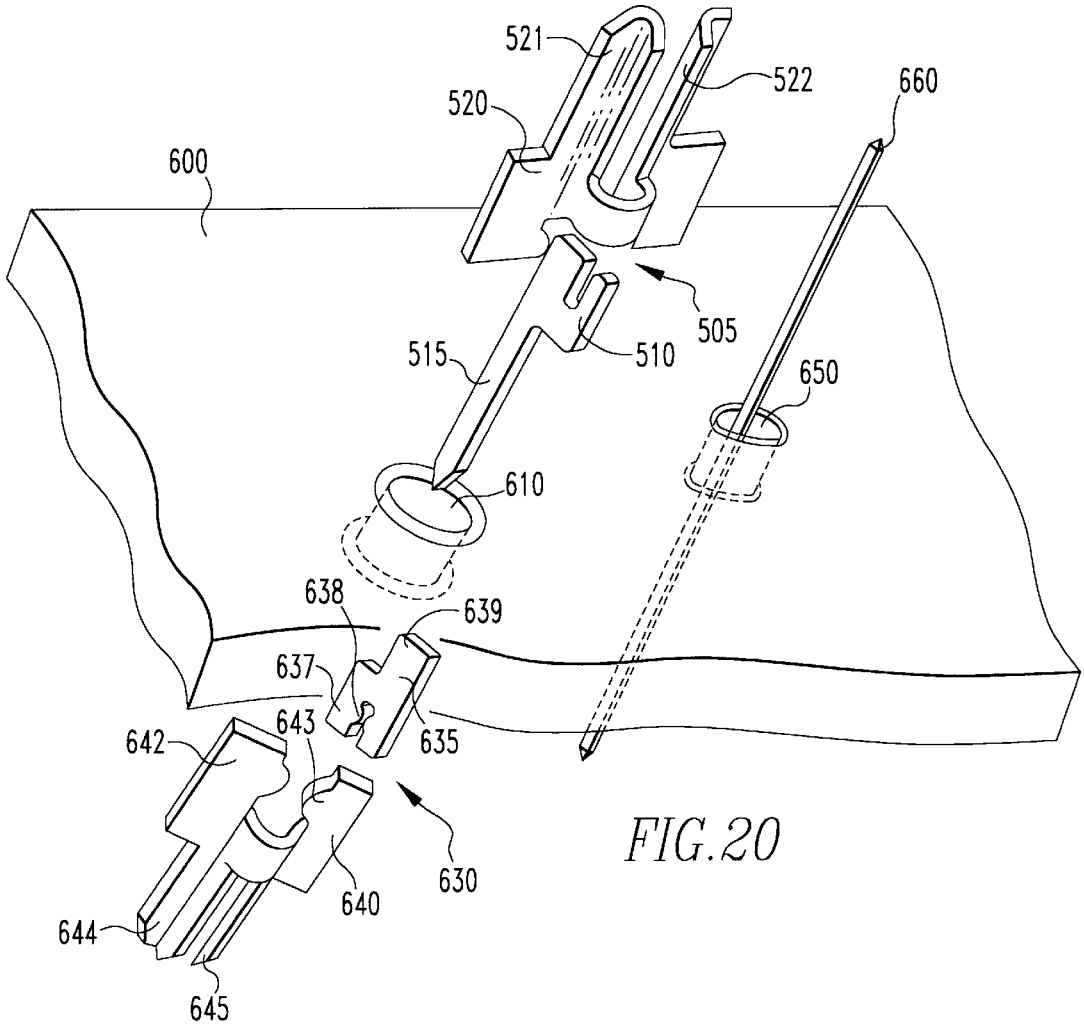
FIG. 20 is a perspective view of an exemplary ground pin and signal pin incorporated in a midplane application in accordance with the present invention, with the parts separated.
Figure 21:
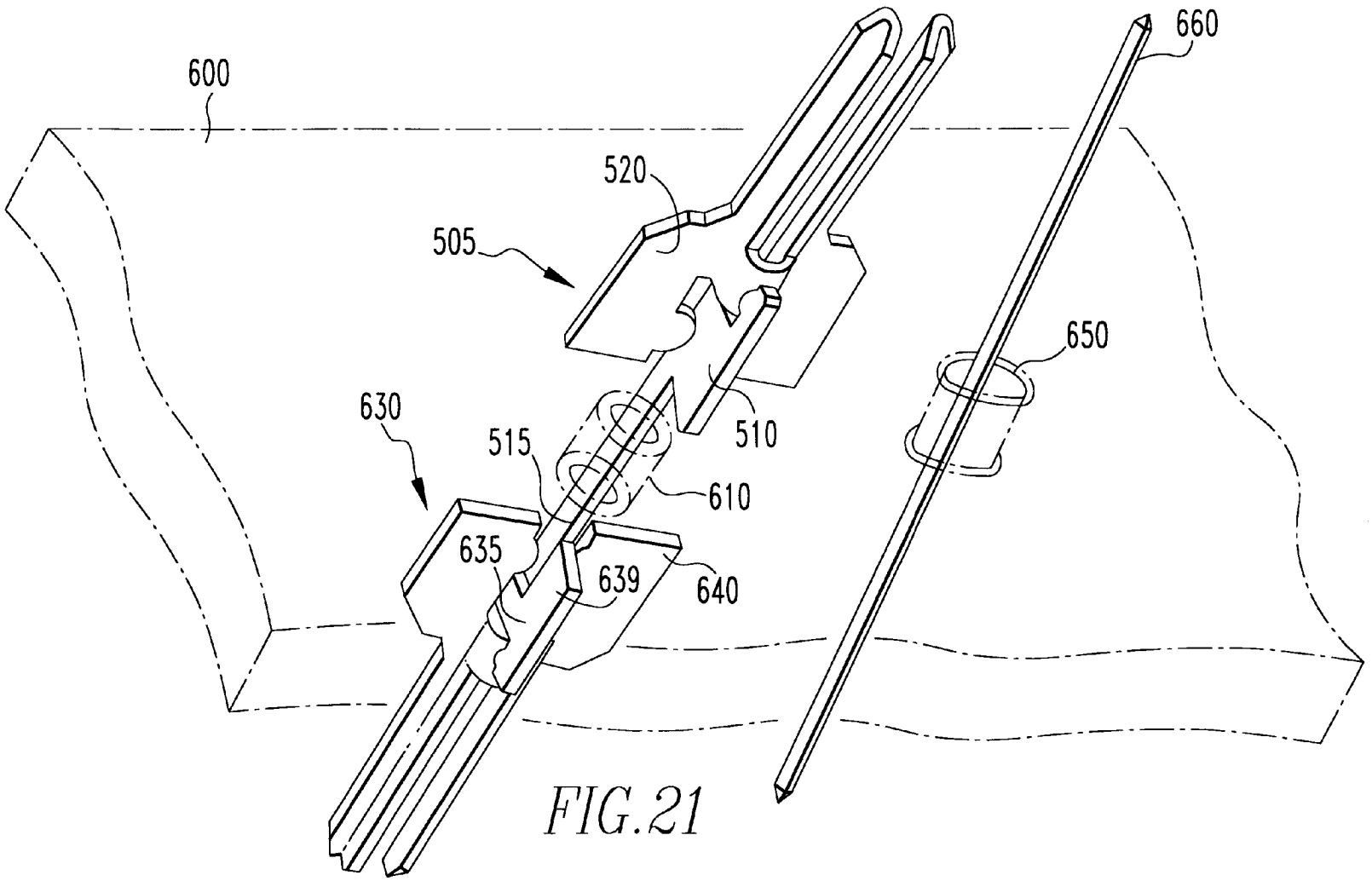
FIG. 21 is a perspective view of an exemplary ground pin and signal pin incorporated in a midplane application in accordance with the present invention, with the parts assembled.

A connector in accordance with the present invention can be used in midplane applications. FIG. 20 is a perspective view of an exemplary ground pin and signal pin incorporated in a midplane application in accordance with the present invention, with the parts separated. FIG. 21 is a perspective view of the exemplary ground pin and signal pin incorporated in a midplane application of FIG. 20, with the parts assembled, and FIG. 22 is a side view of the two ground pins of FIG. 20 contacting each other.

FIG. 20 shows a midplane circuit board 600 with a through-hole 610 for a ground pin 505, preferably comprising two pieces 510 and 520 (similar to ground pin 317 of FIG. 15A), but can be formed of any number of pieces, including only one piece. Also shown is a through-hole 650 for a signal pin 660. A tail 515 of a ground pin contact section 510 is inserted through the through-hole 610 and contacts a ground pin 630 on the other side. The ground pin 630 is similar to the ground pin 317 of FIG. 15A and preferably comprises a contact section 635 and a contact section 640, but can be formed of any number of pieces, including only one piece. The contact section 640 is identical to the contact section 520. It should be noted that any number of pins, not just the exemplary two pins shown as pins 521, 522 and 641, 645 for contacting associated ground receptacle contacts, can be disposed on the contact sections 520 and 640. The contact section 635 has protrusions 637, raised portions or bumps 638, and a short tail 639. The contact section 640 has protrusions 642 and raised portions or bumps 643. The protrusions 637 and bumps 638 cooperate with the protrusions 642 and bumps 643 to interconnect the contact sections 635 and 640.

Figure 22:
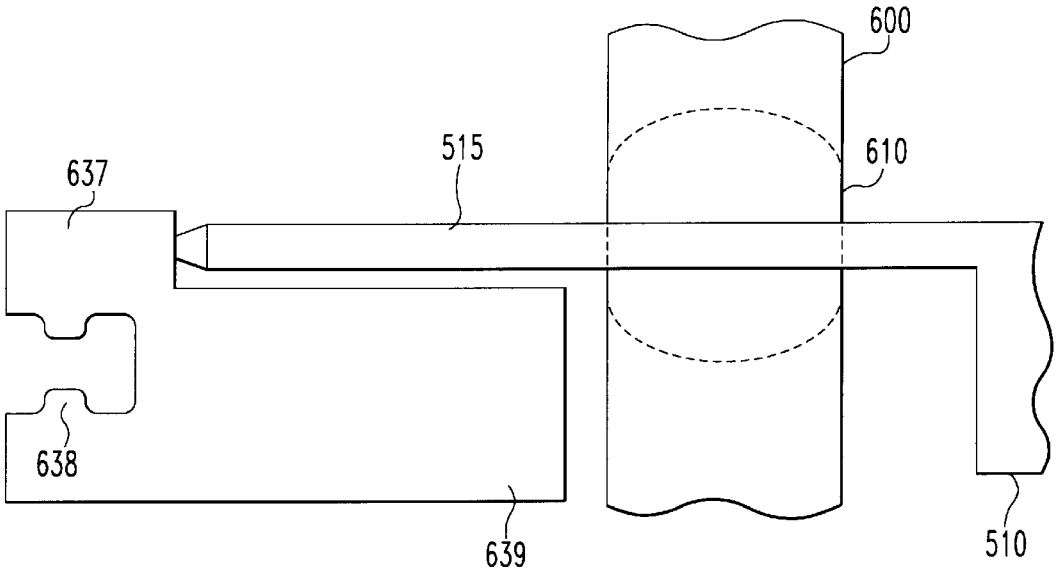
FIG. 22 is a side view of a portion of FIG. 21.

As shown in further detail in FIGS. 21 and 22, the tail 515 of the contact section 510 which passes through the through-hole 610 passes over the short tail 639 and electrically contacts the protrusion 637 in order to pass the ground to the next board (not shown). Preferably, the ground contact sections 635 and 640 are placed in a shroud (not shown) or an empty housing header without pins. The shroud plugs on the back or underside of the midplane board 600, with the signal pin 660 (similar to signal pin 315) passing through the board 600 and the shroud. The short tail 639 electrically shields the columns in the shroud.

The present invention allows implementation of full electrical isolation within the contact engagement zone in a more compact fashion. Moreover, the present invention maintains full isolation in the diagonal direction.

It should be noted that although the ground pin(s) that engage the associated ground receptacle contact(s) of the illustrated embodiments are provided with an L-shape, the present invention is not limited thereto. The use of other shapes, such as rectangular, square, and round, is also contemplated.

It should be noted that although the socket connector of the illustrated embodiment is provided with right angle portion, the present invention is not limited thereto. For example, the present invention can be applied to a socket connector (not shown) having a straight type ground contact and a straight type signal contact, without a right angle portion.

Although illustrated and described herein with reference to certain specific embodiments, the present invention is nevertheless not intended to be limited to the details shown. Rather, various modifications may be made in the details within the scope and range of equivalents of the claims and without departing from the invention.

What is claimed:

1. A connector for mounting to a circuit substrate comprising:

a housing, and a connector module supported by said housing, said connector module including:

a header connector comprising a ground pin and a signal pin; and a socket connector comprising a ground receptacle contact and a signal receptacle contact, wherein said ground pin engages said ground receptacle contact to generate forces in a first and a second direction, and said signal pin engages said signal receptacle contact to generate forces in a third and a fourth direction, said forces in said first and third directions opposing each other and said forces in said second and fourth directions opposing each other.

2. The connector of claim 1, wherein said signal pin is disposed diagonal to said ground pin.

3. The connector of claim 1, wherein said ground pin has an L-shaped cross-section having two sides at the end of the L-shape, said ground receptacle contact has an L-shaped cross-section, and said signal receptacle contact has an L-shaped cross-section, and said ground pin engages said ground receptacle contact at said two sides of the L-shape.

4. The connector of claim 3, wherein said ground receptacle contact and said signal receptacle contact are 90 degree offset dual beam contacts.

5. The connector of claim 3, wherein said ground receptacle contact is disposed in a reversed orientation with respect to said signal receptacle contact.

6. The connector of claim 1, wherein said signal pin has a rectangular cross-section and engages said signal receptacle contact on two adjacent sides.

7. The connector of claim 1, wherein said first and second directions are perpendicular to each other, and said third and fourth directions are perpendicular to each other.

8. A connector module for mounting to a circuit substrate comprising:

a header connector comprising a ground pin and a signal pin; and a socket connector comprising a ground receptacle contact and a signal receptacle contact, wherein said ground pin engages said ground receptacle contact to generate forces in a first and a second direction, and said signal pin engages said signal receptacle contact to generate forces in a third and a fourth direction, said forces in said first and third directions opposing each other and said forces in said second and fourth directions opposing each other.

9. The connector module of claim 8, wherein said signal pin is disposed diagonal to said ground pin.

10. The connector module of claim 8, wherein said ground pin has an L-shaped cross-section having two sides at the end of the L-shape, said ground receptacle contact has an L-shaped cross-section, and said signal receptacle contact has an L-shaped cross-section, and said ground pin engages said ground receptacle contact at said two sides of the L-shape.

11. The connector module of claim 10, wherein said ground receptacle contact and said signal receptacle contact are 90 degree offset dual beam contacts.

12. The connector module of claim 10, wherein said ground receptacle contact is disposed in a reversed orientation with respect to said signal receptacle contact.

13. The connector module of claim 8, wherein said signal pin has a rectangular cross-section and engages said signal receptacle contact on two adjacent sides.

14. The connector module of claim 8, wherein said first and second directions are perpendicular to each other, and said third and fourth directions are perpendicular to each other.

15. A ground pin connector for use in a mid-plane circuit board having at least one through-hole, comprising:

a first ground pin and a second ground pin disposed on opposite sides of said midplane circuit board, each of said ground pins having a tail and a contact section, said contact section including a first contact pin, said tail of said first ground pin passing through said at least one through-hole and engaging said contact section of said second ground pin on the side of said midplane circuit board associated with said second ground pin;

a first ground receptacle contact, said first contact pin of said first ground pin engaging said first ground receptacle contact; and a second ground receptacle contact, said first contact pin of said second ground pin engaging said second ground receptacle contact.

16. The ground pin connector of claim 15, wherein each of said first contact pins has an L-shaped cross-section.

17. The ground pin connector of claim 15, wherein each said contact section of said first and second ground pins further comprises a second contact pin.

18. The ground pin connector of claim 17, wherein each of said first and second contact pins has an L-shaped cross-section.

19. The ground pin connector of claim 17, wherein said first and second contact pins of each said respective contact section are disposed in a mirror relationship.

20. The connector module of claim 15, wherein said tail of said second ground pin has a smaller length than said tail of said first ground pin.

21. A connector module for mounting to a circuit substrate comprising:

a header connector comprising a ground pin and a signal pin; and a socket connector comprising a ground receptacle contact and a signal receptacle contact, wherein said ground pin engages said ground receptacle contact to generate a resultant force in a first direction, and said signal pin engages said signal receptacle contact to generate a resultant force in a second direction, said resultant force in said first direction being approximately equal in magnitude and approximately opposite in direction to said resultant force in said second direction such that said resultant force in said first direction offsets said resultant force in said second direction to balance said connector module.

22. The connector module of claim 21, wherein said signal pin is disposed diagonal to said ground pin.

23. The connector module of claim 22, wherein said resultant force in said first direction is diagonal to said ground receptacle contact and said resultant force in said second direction is diagonal to said signal signal receptacle contact.

24. An electrical interconnection comprising:

a header connector having a first substantially rectangular array of signal pins and a second substantially rectangular array of ground pins, said first and second arrays being offset along a diagonal direction one with respect to the other;

a receptacle connector comprising a third substantially rectangular array of signal receptacle terminals arranged to mate with the first array of signal pins and a fourth substantially rectangular array of ground receptacle terminals arranged to mate with the second array of ground pins, said third and fourth arrays being offset and diagonally related one with respect to the other;

each signal receptacle terminal comprising a pair of contact elements, one contact element applying a contact force generally transverse to a mating pin in a first direction and the other contact element applying a contact force on the pin in a second direction orthogonal to the first direction;

each ground receptacle terminal comprising a pair of contact terminals, one of the ground receptacle contact terminals applying a contact force transverse to a mating pin in a direction parallel and opposite to the first direction and the other ground receptacle contact terminal applying a contact force to the mating pin in a direction parallel and opposite to the second direction.

25. The interconnection of claim 24, wherein a first resultant of the contact forces on the signal pin and a second resultant of the contact forces on the ground pin are substantially equal and in opposite directions.

26. The interconnection of claim 25, wherein the first and the second resultants are co-linear along said diagonal direction.

27. An interconnection system, comprising:

a first connector having a plurality of contacts; and a second connector mateable with said first connector and having a plurality of contacts;

wherein one of said plurality of contacts on said first connector engages one of said plurality of contacts on said second connector in a plurality of non-opposing directions, creating a first unbalanced resultant force; another one of said plurality of contacts on said first connector engages another one of said plurality of contacts on said second connector in a plurality of non-opposing directions, creating a second unbalanced resultant force generally equal in magnitude to said first unbalanced resultant force, but generally opposite in direction to said first unbalanced force.

28. The interconnection system as recited in claim 27, wherein said plurality of contacts on said first and second connectors each comprise an array of ground and signal contacts.

29. The interconnection system as recited in claim 28, wherein one of said signal contacts on said first connector creates said first unbalanced resultant force on one of said signal contacts on said second connector; and one of said ground contacts on said first connector creates said second unbalanced resultant force on one of said ground contacts on said second connector.

30. The interconnection system as recited in claim 27, wherein said first connector is a receptacle mountable on a circuit substrate and said second connector is a header mountable on another circuit substrate.

31. The interconnection system as recited in claim 27, wherein said plurality of non-opposing directions are generally perpendicular to each other.

32. The interconnection system as recited in claim 28, wherein said around contacts on said second connector each include a plurality of pins.

33. The interconnection system as recited in claim 32, wherein said ground contacts on said second connector comprises a first contact section and a second contact section, said first contact section coupled to said second contact section, and said plurality of pins are provided on said second contact section.

34. The interconnection system as recited in claim 33, wherein each of said first and second contact sections has a plurality of protrusions and raised portions, said protrusions and raised portions in a cooperative relationship to couple said first contact section to said second contact section.

35. The connector of claim 32, wherein said ground terminal has a tail and said connector module further comprises a second ground terminal in electrical contact with said tail of said ground terminal.

36. The interconnection system as recited in claim 32, wherein said ground contacts on said second connector have two pins.

37. The interconnection system as recited in claim 36, wherein one of said two pins engages one of said ground contacts on said first connector and the other of said two pins engages another of said ground contacts on said first connector.

38. The interconnection system as recited in claim 36, wherein said two pins are disposed in a mirror relationship.

39. The interconnection system as recited in claim 36, Wherein each of said two pins has an L-shaped cross-section.

40. The interconnection system as recited in claim 31, wherein each of said signal contacts of said second connector have a rectangular cross-section and engage a corresponding one of said signal contacts of said first connector on two adjacent sides.

41. The interconnection system as recited in claim 39, wherein said ground and signal contacts on said first connector have L-shaped cross-sections.

42. The interconnection system as recited in claim 41, wherein said ground and signal contacts on said first connector are 90 degree offset dual beam contacts.

43. The interconnection system as recited in claim 41, wherein said ground contacts of said first connector are disposed in a reversed orientation with respect to said signal contacts of said first connector.

44. An interconnection system, comprising:

a first connector having a housing and a plurality of contacts, said contacts including cantilevered mating regions extending from said housing and having a cross-section defined by a Durability of sides; and a second connector mateable with said first connector and having a plurality of contacts, each engageable with a mating region of a corresponding contact on said first connector at non-opposing locations on at least two of said plurality of sides;

wherein each one of said plurality of contacts on said first connector engages a corresponding one of said plurality of contacts on said second connector to create an unbalanced resultant force on each of said plurality of contacts on said second connector, said unbalanced resultant forces generally offsetting each other to provide a balanced interconnection system.

45. The interconnection system as recited in claim 44, wherein said plurality of contacts on said first and second connectors each comprise an array of ground and signal contacts.

46. The interconnection system as recited in claim 45, wherein said signal contacts are disposed diagonal to said ground contacts.

47. The interconnection system as recited in claim 45, wherein one of said signal contacts on said second connector has a first unbalanced resultant force and one of said ground contacts on said second connector has a second unbalanced resultant force that is equal in magnitude, but opposite in direction, to said first unbalanced resultant force.

48. The interconnection system as recited in claim 44, wherein said first connector is a receptacle mountable on a circuit substrate and said second connector is a header mountable on another circuit substrate.

49. The interconnection system as recited in claim 48, wherein at least one of said plurality of contacts extend away from said header a first distance and at least another one of said plurality of contacts extend away from said header a second distance less than said first distance.

50. The interconnection system as recited in claim 49, further comprising a circuit board having a first and a second through hole, wherein one of said contacts of said header passing through said first through hole to electrically contact a corresponding contact on said receptacle located on the other side of said circuit board, and another one of said contacts of said header passing through second through-hole.

51. An electrical connector, adapted to engage a mating electrical component to form a system, and comprising:

an insulative housing; and a plurality of multiple beam contacts, each contact adapted to mate with a corresponding contact on the mating component at non-opposing locations, each beam of said contact having structure for engaging a different side of the corresponding contact on the mating component, and each said contact producing an unbalanced resultant force, said unbalanced resultant forces generally offsetting each other to provide a balanced system.

52. The electrical connector as recited in claim 51, wherein said multiple beam contacts are dual beam contacts.

* * * * *